United States Patent [19]

White et al.

[11] 4,045,940

[45] * Sept. 6, 1977

[54] BALER SYSTEM AND METHOD

[75] Inventors: Thomas J. White, San Ramon; Henry L. Spence, Pleasanton; Etheridge R. McClelland, Livermore, all of Calif.

[73] Assignee: Filper Corporation, Reno, Nev.

[ * ] Notice: The portion of the term of this patent subsequent to Sept. 6, 1991, has been disclaimed.

[21] Appl. No.: 290,894

[22] Filed: Sept. 21, 1972

[51] Int. Cl.[2] ..... B65B 35/50; B65B 57/10

[52] U.S. Cl. ..... 53/26; 53/62; 53/159; 53/164; 53/187; 53/253

[58] Field of Search ..... 53/26, 61, 62, 159, 53/164, 187, 188, 253

[56] References Cited

U.S. PATENT DOCUMENTS

| | | | |
|---|---|---|---|
| 3,057,382 | 10/1962 | Baker | 141/83 |
| 3,138,907 | 6/1964 | Gerbe | 53/188 X |
| 3,399,507 | 9/1968 | Litchard | 53/188 X |
| 3,513,624 | 5/1970 | Adcox | 53/62 |
| 3,670,474 | 6/1972 | Vieson et al. | 53/62 X |
| 3,688,471 | 9/1972 | Clark et al. | 53/188 |

*Primary Examiner*—Travis S. McGehee

[57] ABSTRACT

In the overall system, vertically disposed, primary bags are filled with articles to a predetermined weight and conveyor means conduct the filled primary bags to a discharge point where a predetermined number of said filled bags are discharged at a discharge point and fall into an upright master bag, after which the filled master bag is carried away and closed, and an empty bag is positioned to receive primary bags of said predetermined number from said conveyor means.

During the interval of time when a filled master bag is moved away from the receiving point where it is filled, and an empty bag replaces it, the discharge of bags continues at said discharge point, but are accumulated until the replacement empty master bag is in receiving position, and then the accumulated bags are released to fall by gravity into the empty master container as a unit, and the passage through the accumulator remains open until the additional bags to make up the total required predetermined number pass directly into the primary bag from said discharge point.

Also the conveyor means toward the discharge point is continuous up to a transfer location and is intermittent from said location to the discharge point, and control means automatically precludes the occurrance of an underfilled master bag without stopping or slowing the conveyor means.

19 Claims, 23 Drawing Figures

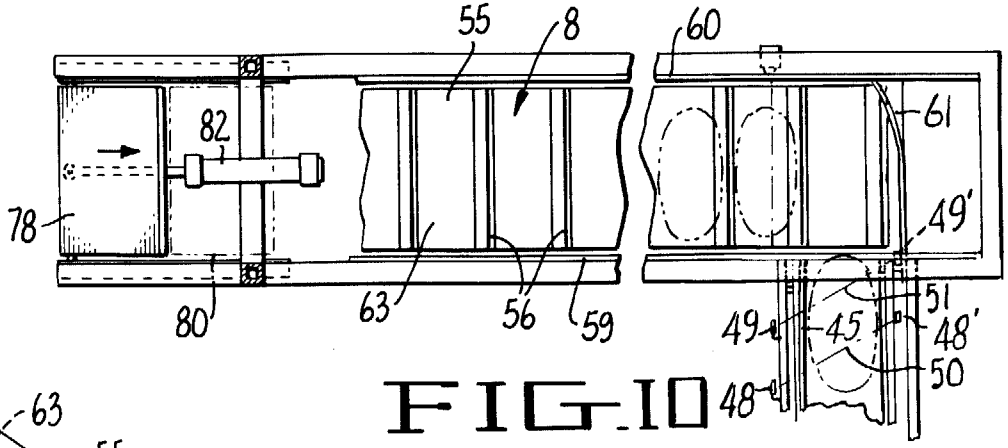
FIG. 10
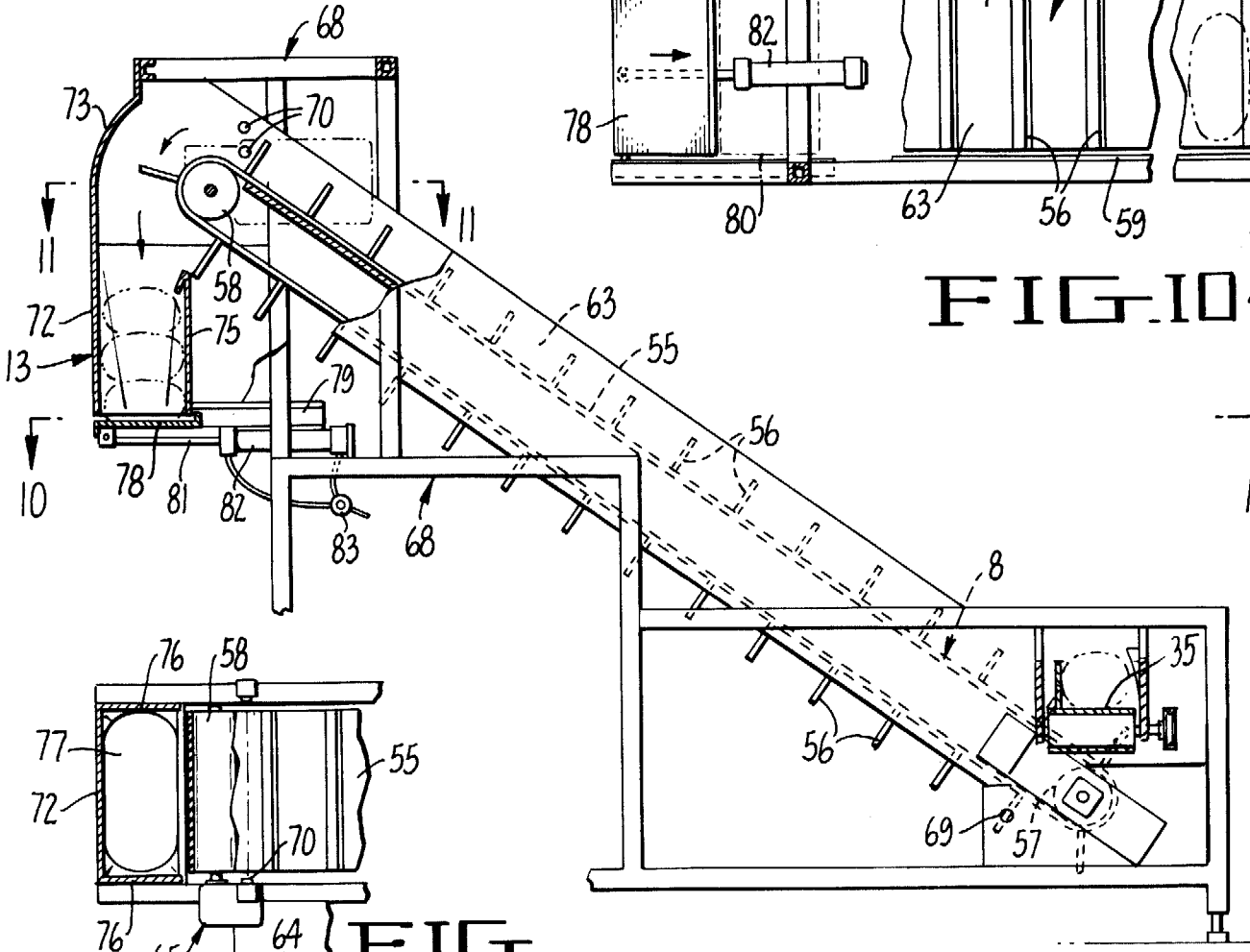
FIG. 9
FIG. 11

BALER SYSTEM AND METHOD

SUMMARY

The overall system or assembly may include a machine such as shown and described in U.S. Pat. No. 3,057,382 of Oct. 9, 1962 known in the industry as Weigh-O-Matic. In this machine bags in a row are suspended from their upper open ends for receiving discrete articles to a uniform total weight as the empty bags of a row thereof successively move past a filled station.

The empty bags may be manually attached to the machine, or automatically attached as provided for in U.S. Pat. No. 3,495,378 of Feb. 17, 1970 to R. F. Kipers.

The words "primary" and "master" as hereafter used with reference to the containers or bags respectively refer to the initially filled containers or bags that receive the discrete articles, and to the secondary larger containers or bags that receive, or that are to receive, a predetermined plurality of the filled primary bags or containers to form packages or bales, each package or bag containing said predetermined plurality.

While the primary and master containers are specifically shown and described as being bags, the invention, in the broader aspects, is not necessarily restricted to bags, unless specifically so claimed.

Commencing with vertically elongated primary bags or containers filled with discrete articles to a predetermined weight, said bags or containers are arranged in a succession in a generally horizontally extending path and are moved in one direction longitudinally of said path to a discharge point.

The direction of the path itself may change between the filling station for the primary containers, and the discharge point, but the row with the containers disposed in a succession therein remains.

At one point along said path the filled primary containers are secured closed at their upper ends, while upright, and are positioned in substantially uniformly spaced relation, and are thereafter automatically positioned on one of their sides in end-to-end, substantially uniformly spaced relation until they reach a predetermined transfer location where they are automatically arranged in side-by-side, uniformly spaced relation in the row for successive discharge from said path in this position at said discharge point.

The movement of the primary containers is continuous up to said predetermined location, and thereafter the movement is intermittent to said discharge point.

Master containers are intermittently successively positioned below said discharge point in a receiving position for receiving a uniform predetermined plurality of the primary containers discharged from said point.

After each master container has received the predetermined plurality of primary containers, it is continuously moved along a path separate from that of the primary containers past a closing station, where it is secured closed and then to a discharge station, and a replacement container is positioned in a receiving position for receiving said predetermined plurality from said discharge point.

Heretofore the rate of baling bags or containers has been relatively slow. In machines for packing primary bags, the customary procedure is to push one bag at a time from an endless conveyor on to an accumulator, until a predetermined number of bags has been accumulated. The bags following the first one onto the accumulator advance those ahead of them until the desired number is on the accumulator, and the conveyor delivering the bags to the reciprocable pusher must stop during the reciprocable movement of the pusher. After the bags are accumulated they are either discharged, as a completed group, into a bag that is positioned to receive them, or they may be discharged into a delivery chute or the like for sliding into a bag.

In the present instance, the bags are intermittently discharged at a uniform rapid rate, directly onto an accumulator during the time interval required to remove a primarily filled master bag and to position its replacement.

As one example, assuming five filled primary bags is the total required for a bale or master bag, during the time the primarily filled master bag has been removed and replaced by an empty bag, three of the five primary bags have been accumulated on the accumulator that is over the upwardly opening master bag. The accumulator is then opened and the three bags drop by gravity into the master bag and before the accumulator closes two additional bags are discharged from the conveyor to drop directly through the accumulator into the master bag.

Controls are provided for varying the timing so that the total predetermined number of primary bags discharged into the master bags may vary but which number will remain uniform after each of the timing adjustments is made in the controls. These controls themselves are conventional.

One of the objects of this invention is the provision of a method and means for accelerating the baling operation to provide more bales or completed master containers per hour than heretofore.

Another object of the invention is the provision of a baling system and method that is relatively simple and free from interruptions due to faulty operations.

A still further object of the invention is the provision of a baling machine that has wide flexibility for different pluralities of packaging primary containers or bags.

An additional object is the provision of an improved control system for insuring a more consistent uniformity in packaging pluralities of primary containers or bags in master containers or bags.

Other objects and advantages will appear in the description and drawings.

DESCRIPTION OF DRAWINGS

FIG. 9 is an enlarged part elevational, part sectional view taken substantially along line 9—9 of FIG. 1.

FIG. 10 is a top plan view of FIG. 9 along line 10—10 of FIG. 9, the view being broken in length.

FIG. 11 is a cross-sectional view taken along line 11—11 of FIG. 9.

DETAILED DESCRIPTION

Method

Figure 1:
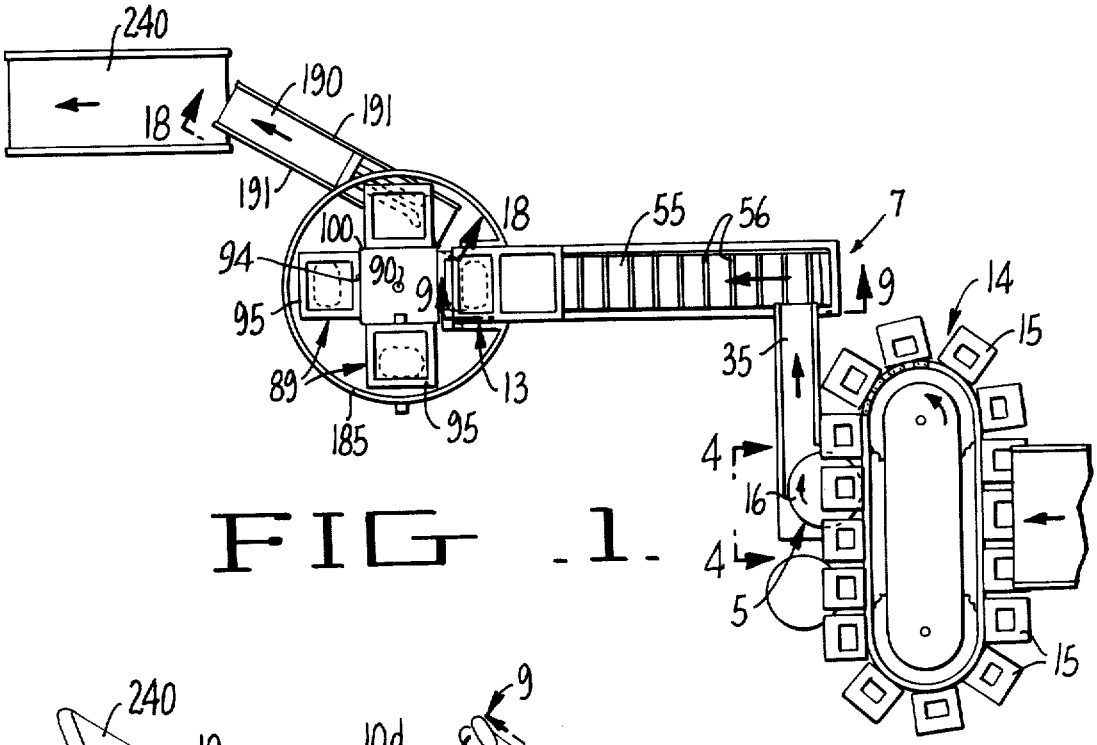
FIG. 1 is a simplified top plan view of the baler system or method.
Figure 2:
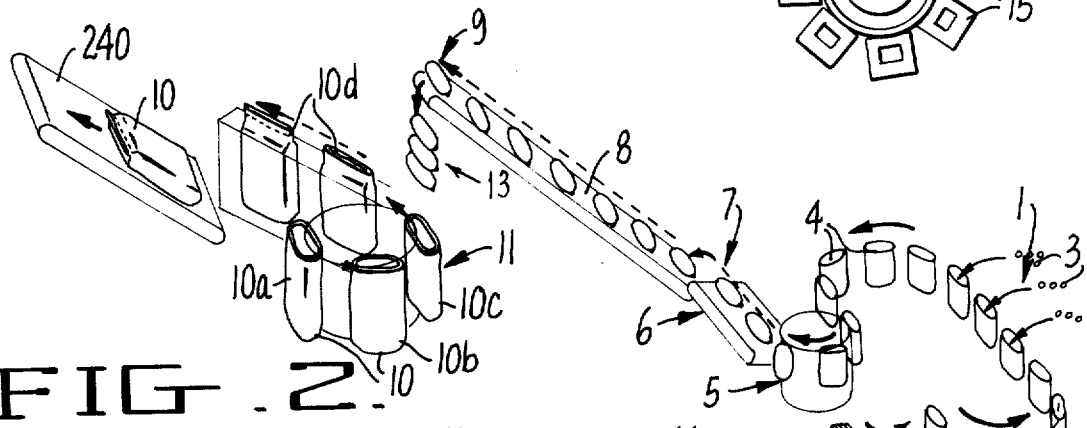
FIG. 2 is a schematic view showing the path of travel of the primary bags from the primary bag filling station to and past the baling station where the master bags are filled, closed, and discharged.

FIG. 2 is illustrative of the steps in the method that the assembly of FIG. 1 is adapted to carry out. The numeral 1, in FIG. 2 is the initial loading station where a succession of vertically elongated empty primary bags 2 are arranged vertically in a row with their upper ends open for receiving discrete articles 3 at said station 1.

The bags are continuously moved past said loading station, where each receives a substantially uniform predetermined weight of said articles. The filler primary bags are designated 4. The movement of the bags 4 is in one direction longitudinally of the row to a take-off station 5 where the path of travel diverges and the filled and closed primary bags are positioned on their sides in end-to-end spaced relation, upon leaving take-off station, without stopping their continuous movement in said path.

The portion of the path of movement of the bags extending away from the take-off station is designated 6, and as each bag leaves the take-off station its movement along the path away from said station is preferably accelerated to provide a substantially uniform spacing between bags.

At a transfer location 7 at the end of portion 6 of the path of movement of the bags, the bags are discharged, one at a time onto a surface 8 that is intermittently moved away from said transfer location in a direction at a right angle to the portion 6 of the path of travel of the bags.

Upon each bag 4 being deposited on the surface 8 the latter moves away from the transfer location carrying bag 4 and the next bag discharged from portion 6 of the path will be spaced behind it and the bags will then be in side-by-side relation to each other, and will intermittently move to a discharge point 9 where they will be discharged one at a time for falling by gravity.

Below said discharge point 9 is a succession of vertically elongated empty master bags 10. These bags are suspended from their upwardly opening ends for successive movement to a primary bag receiving station 11.

One of the master bags 10 is shown in FIG. 2 in a position 10*a* at a bag applying position, for movement from said position to a position 10*b*, and from position 10*b* to the primary bag receiving position 10*c* where it is filled with a predetermined number of primary bags. After being filled at position 10*c*, the filled master bags are moved to and past position 10*d* where their upper ends are secured closed. The master bags are then discharged and are carried away for storage or shipment.

Assuming five primary bags is the quota for each master bag, as soon as a master bag at position 10*c* has received its five bags, the filled bag will be moved to position 10*d* and the empty master bag at position 10*b* will be moved to position 10*c* at the station 11. During this interval of time the primary bags 4 will continue to be discharged from the discharge point 9. The bags so discharged will be accumulated, one on the other, at an accumulation station 13 that is between the discharge point 9 and the primary bag receiving station 11. An obstruction at the station 13 enables this accumulation, which obstruction is removed upon the bag at position 10*b* being moved to position 10*c* at the station 13, and the three primary bags 4 at the accumulation station 13 freely drop by gravity into the master bag in position 10*c* at the accumulation station followed in rapid succession by two additional bags discharged from discharge point 9 before the obstruction is restored, and before the bag at 10*c* is removed.

From the above description it is seen that no delay occurs in the movement of the primary of master bags due to waiting for a full accumulation of the primary bags before their discharge into a master bag, nor is there any waiting for reciprocable pushers to complete a reciprocatory movement before movement of the bags can be resumed.

Bag-Filling Machine

Figure 5:
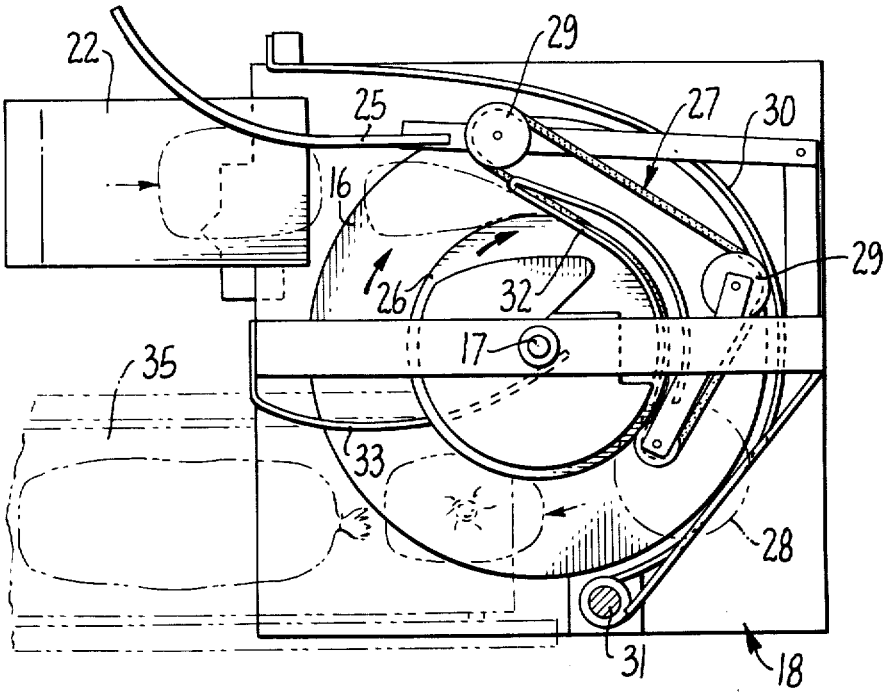
FIG. 5 is a top plan view of the apparatus of FIG. 4.
Figure 6:
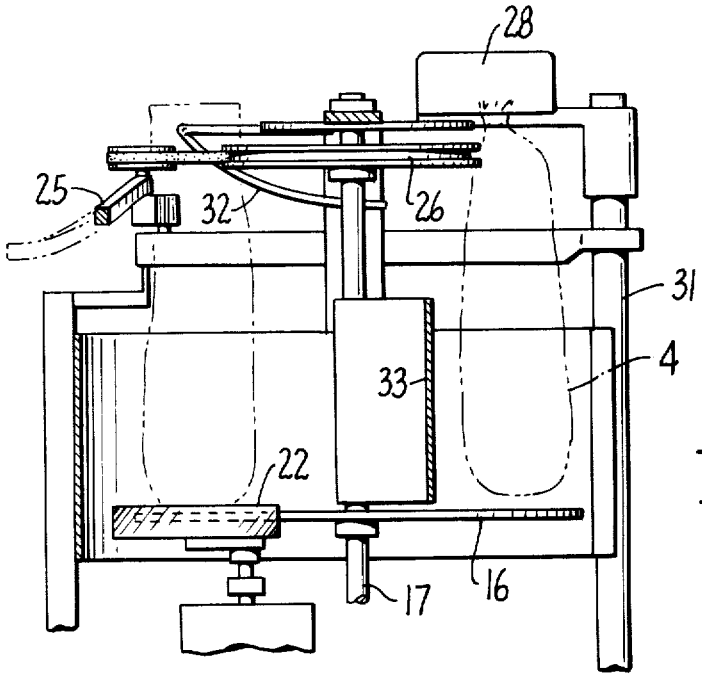
FIG. 6 is a fragmentary part sectional, part elevational view taken along line 6—6 of FIG. 4, primary bags being indicated in dot-dashed lines.

In FIG. 1 a reduced, simplified top plan view, partly schematic, of apparatus for carrying out the steps of the method, is shown. A conventional Weigh-O-Matic machine 14, as shown and described in U.S. Pat. No. 3,057,382, supports and fills the bags 2. The bags 12 are suspended from their upper ends below hoppers 15, and scales associated with the suspended bags movable under the influence of the weight of articles deposited in the bags actuate elements to deflect articles from entering the bags after each has received a predetermined weight of articles. The bag holding elements from which the filled bags are suspended are actuated in response to movement to the take-off station to release the bags at the take-off station 5 where they are deposited, successively, upon said release onto a horizontal, circular turn table 16 (FIGS. 5, 6).

Take-Off Station (Table)

A vertical central shaft 17 (FIG. 4) supports table 16 and the upper and lower ends of said shaft are supported for rotation in bearings on a stationary frame 18. The lower end of shaft 17 is driven by a motor 19 (FIG. 4) that is connected by a chain 20 with a sprocket wheel 21 secured on the lower end of said shaft.

Figure 4:
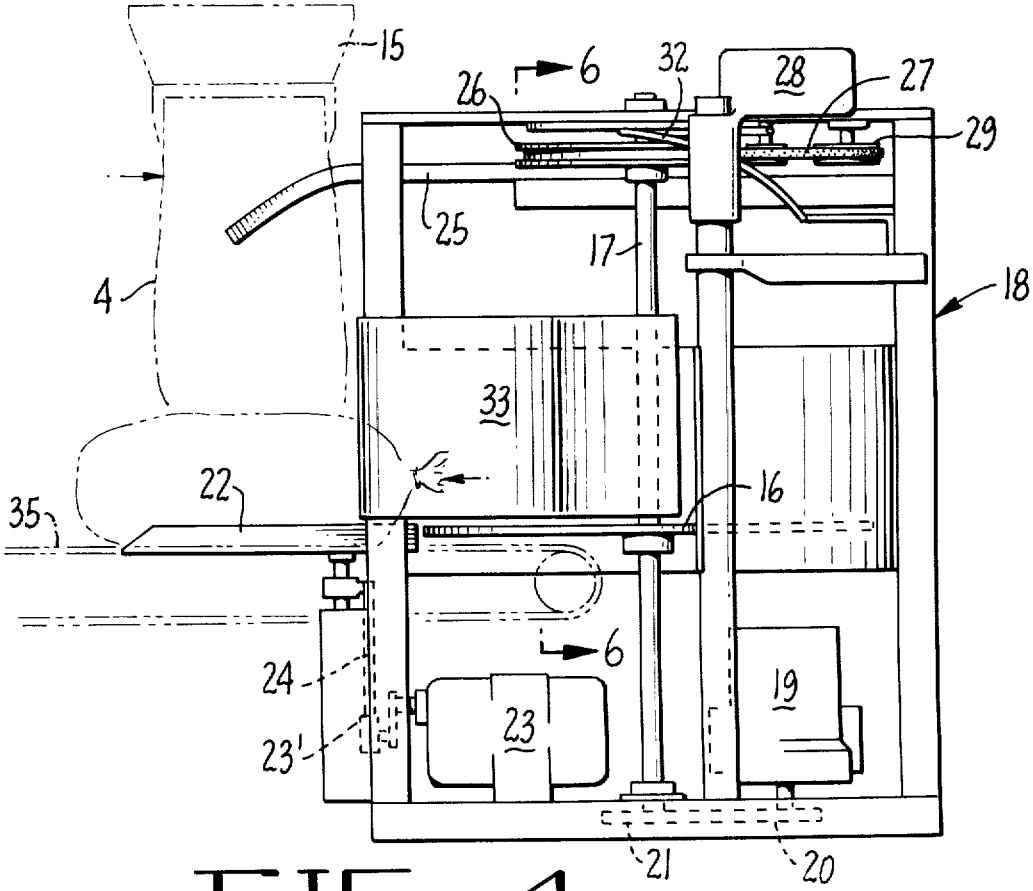
FIG. 4 is a side elevational view of bag-transfer apparatus for transferring primary bags to a transfer conveyor extending to an elevator for discharge into the master bags.

Table 16 extends below the path of travel of the suspended bags 4 on the Weight-O-Matic machine and just before each bag is moved to a position over the table, the filled bag is carried over and is sliding engagement with a vertically reciprocable jogging plate 22 that is driven by a motor 23 (FIG. 4). Jogging of plate 22 settles the articles in the vertically disposed bag 4 inasmuch as articles, such as potatoes, may tend to be loosely positioned due to irregularity in shape and size. A motor driven shaft drives a crank or eccentric 23' that, in turn, vertically reciprocates a link 24 connected with a vertically reciprocable support for plate 22 (FIG. 4). A bag 4 in jogging position on plate 22 is indicated in dot-dash lines in FIG. 4.

A primary bag 4, will still suspend from its open upper end is carried against the downwardly extending end of a curved horizontally extending guide rod 25 (FIGS. 4, 5) on frame 18 that guides the upper end of the bag as it is carried by table 16 so that the leading side of the upper portion of the bag is gripped between the radially outwardly opening recessed edge of a circular disc 26 and a portion of an endless belt 27 that is adapted to fit in the recess in the outer periphery of said disc. The portion of belt 27 held in engagement with the bag 4 extends to a conventional automatic gatherer and bag closer 28. The upper portion of the bag 4 is tightly gripped, and flattened as it is carried around disc 26 and the flattened portion is gathered and tied or stapled closed by the bag closer 28 responsive to engagement with the gathered portion of the bag and movement of the bag past the closer. One such conventional bag closer is manufactured by the New Jersey Wire Stitching Machine Co. of New Jersey, U.S.A. and is known in the trade as a New Jersey Automatic Bag Closer.

The circular disc 26 is secured on shaft 17 and is driven at the same speed as table 16. Usually the bag 4 may be slightly spaced above table 26 when it leaves the jogging table but may sag to engage the table by the time it reaches and leaves the tying machine 28 (FIG. 6).

The endless belt 27 (FIG. 5) extends around idlers 29 that are supported at spaced points on frame 18 and hold the bag gripping portion of the belt in arcuately extending bag gripping position extending to the bag machine.

An outer arcuately extending guide plate 30 defines the outer side of the arcuately extending path of travel of each bag 4 to and past the bag closure to terminate at the post 31 supporting the bag closure, while an inner arcuately extending guide rod 32 (FIGS. 4–6) is adapted to engage the upper side of the bag along the inner side of its path to the bag closer.

After each bag 4 passes the bag closer with its upper end gathered and tied in closed position, it strikes a deflector plate 33 that extends angularly across the path of the bag causing the latter to fall on its side onto the receiving end of a horizontally extending belt conveyor 35 that is indicated in full line in FIG. 1 and in dot-dash lines in FIGS. 4, 5. The receiving end of conveyor 35 extends under and is spaced slightly below the table 16 adjacent the position of the deflector plate 33 (FIGS. 4, 5).

Conveyor From Take-Off Station to Transfer Location 7

Figure 7:
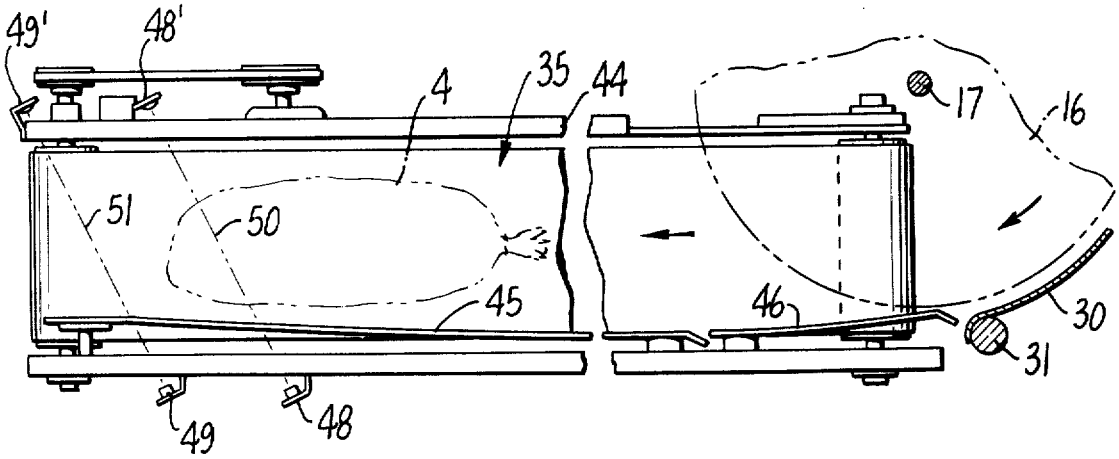
FIG. 7 is a fragmentary top plan view of the transfer conveyor between the bag-transfer apparatus of FIG. 5 and the elevator, part of the bag-transfer apparatus being shown in cross-section and the circular transfer disc or turn table being indicated in dot-dashed lines.
Figure 8:
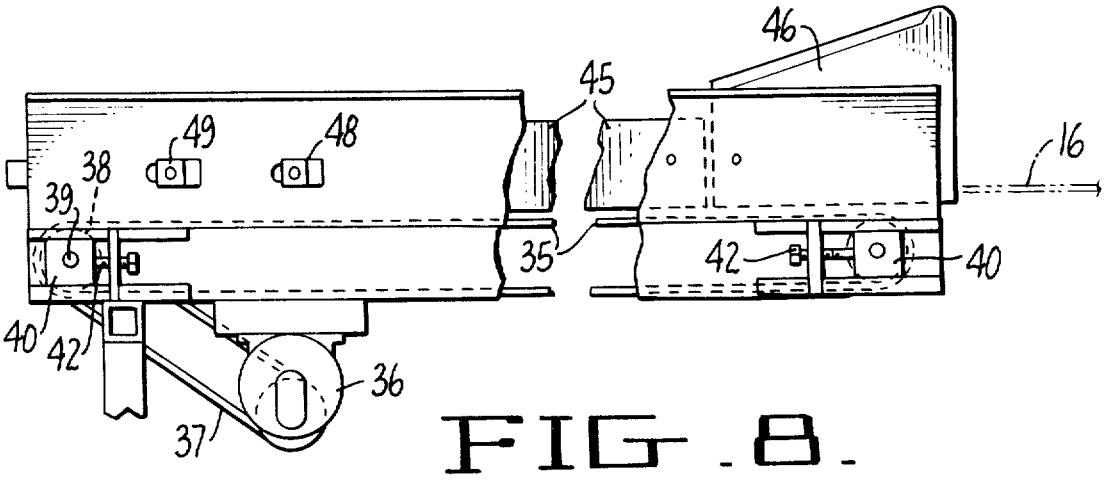
FIG. 8 is a side elevational view of the transfer conveyor shown in FIG. 7.

Conveyor 35 (FIGS. 1, 7, 8) is a standard endless belt conveyor adapted to support the bags 4 thereon, and is continuously actuated for carrying the bags 4 along the portion 6 of the path of travel of bags 4 from table 16 at the take-off station 5 to the transfer location 7 (FIGS. 1, 2).

A motor 36 (FIG. 8) drives the conveyor 35, being connected by a V-belt 37 with a pulley 38 on pulley shaft 39 at one end of the belt 35.

The pulley shafts supporting the conveyor belt pulleys are preferably carried in blocks 40 that are slidably supported on a conveyor frame 41. These blocks are adjustable longitudinally of the belt by adjusting screws 42, thereby enabling adjustment of the position of belt 35 longitudinally.

The upper level of the upper run of conveyor 35 where it extends below the table 16 is spaced slightly below said table forming a downward step. The bag deflecting plate 33 (FIG. 5) on the frame 18 of the take-off table at one side of the receiving end of conveyor 35 functions to shunt bag 4 off the table 16 and over the step down onto the receiving end of conveyor 35, with the result that each bag falls on its side onto conveyor 35 with its closed end in a trailing position on said conveyor. The conveyor 35 preferably moves at a faster rate than table 16, with the result that the bags 4 (indicated in dot-dash lines in FIG. 4, 5) are uniformly spaced apart in end-to-end relation on conveyor 35.

The conveyor 35 terminates at its end remote from the take-off station 5, at the transfer location 7 (FIG. 1, 2) where the filled bags 4 are discharged onto the lower end of an elevator, to be described in detail later, which elevator has the surface 8 (FIG. 2) onto which the bags are discharged. Vertical opposed side walls 44, 45 define the opposite sides of the path 6 of the bags 4 between the take-off station 5 and the transfer location 7. Side wall 44 is fixed, but side wall 45 is adjustable toward and away from wall 44 at the discharge end of the conveyor, and a separate side wall 45 that is adjacent the table 16 extends to post 31. The wall 45 is adjusted to extend convergently toward wall 44 in the direction of travel of bags on conveyor 35 to align the bags longitudinally on conveyor 35 to insure uniformity in their discharge positions at the transfer location 7.

Adjacent the transfer location 7 at the discharge end of conveyor 35 and at one side thereof is a pair of photocells, one being designated 48 and the other designated 49. These pairs of cells are spaced apart longitudinally of the conveyor 35 and are positioned so the beams 50, 51 from light sources 48', 49' are parallel and are directed diagonally across the path of travel of the bags 4 at a level to be intercepted by a bag of normal height and length. The spacing between beams and their arrangement relative to each other is such that a normally filled bag moving to the transfer location 7 will be in a position in which both beams will, at one time, be intercepted or broken by a bag of proper length and height just before discharge of the bag onto the surface 8 (FIGS. 1, 2) that is moved to carry the bag to the discharge point 9 (FIG. 2), while a broken or improperly filled bag will not intercept both beams at one time. This surface 8 is the upper surface of an endless elevator conveyor generally designated 55 (FIG. 1). The function of photocells 48, 49 will be described later.

Elevator From Transfer Location 7 to Discharge Point 9

The elevator comprises an endless belt conveyor 55 that is inclined upwardly from the transfer location 7, and extends at a right angle to conveyor 35.

Conveyor 55 is formed with equally spaced flights 56 extending thereacross and projecting outwardly of the outer surface of the belt at right angles to said surface.

The conveyor belt extends over a lower pulley 57 and an upper pulley 58 (FIG. 9). Side plates or walls 59, 60 (FIG. 10) extend lengthwise of the conveyor and are vertically disposed in spaced opposed relation along opposite longitudinally extending edges of the conveyor belt 55. The wall 59 is along the side of the conveyor 55 that is adjacent the conveyor 35 and extends from conveyor 35 to the upper end of conveyor 55, so that bags 4 on conveyor 35 will be discharged from the latter past its lower end onto conveyor 55. The lower end of the side wall 60 extends past the lower end of conveyor 35 in spaced relation to the discharge end of conveyor 35 to provide a stop for bags 4 discharged onto the lower end of conveyor 55.

An upwardly projecting bag-deflecting and guide plate 61 substantially in longitudinal continuation of the side wall 44 along one side of conveyor 35 extends to the lower end portion of wall 60, and is twisted out of one plane so its upper portion remote from the end adjacent conveyor 35 extends in the direction of movement of conveyor 55 to insure proper discharge of each bag 4 onto conveyor 55 between an adjacent pair of flights 56.

The flights 56 of each adjacent pair on the upper run of conveyor 55, and the plates 59, 60 cooperate to form upwardly opening pockets 63, in each of which a bag 4 is adapted to be positioned on its side with its ends respectively adjacent plates 59, 60 as the bags are carried up the conveyor 55.

Conveyor 55 is intermittently driven by a motor 64 through a conventional clutch brake 65 (FIG. 11) connected with shaft 67 of the upper belt pulley 58.

A frame 68 supports the elevator conveyor 55 and a photocell 69 is carried by said frame, and the beam thereto is directed transversely across the path of flights 56 below the lower run of the conveyor 55, and adjacent the lower end of the conveyor.

It is important that a pair of adjacent flights 56 at the lower end of the conveyor 55 be positioned to receive each filled bag 4 when each such bag is ejected endwise off the discharge end of the continuously running conveyor 35.

It is equally important that no underfilled bag 4 ejected onto the elevator conveyor to be carried to the master bag that is to receive it be counted as a full, properly filled and closed bag. Should the tie on a filled bag 4 be broken, the articles therein such, for example, as potatoes, would spill out of the bag when the bag falls on its side on the receiving end of the conveyor 35. This would result in a partial collapse of the bag or at least a sufficient shortening of its height to fail to effect an interception of both beams 50, 51 to photocells 48, 49 at the same time.

The photocell 69 (FIG. 5) is in an electrical circuit with the clutch and brake assembly driven by the motor 64, and upon intercepting the beam to photocell 69 by each flight the conveyor will stop in a position with the next adjacent pair of flights 56 of the upper run of conveyor 55 at its lower most end in a position to receive a bag 4 ejected from the discharge end of conveyor 35 between said adjacent pair.

Also at the upper end of the conveyor 55 is a vertically spaced pair of photocells 70 in a position in which the light beams thereto will be intercepted by whatever may have been deposited in a pocket 63 and carried by the conveyor to the discharge position, provided it is of a sufficient height to be intercepted by one or the other or both of said photocells.

Photocells 48, 49, 70 and other elements are in an electrical control circuit for controlling the proper filling of master bags, as will later be explained more in detail, a coventional light source being provided to provide a beam for each cell.

The bags 4 carried by the elevator conveyor 55 are discharged, one at a time into an accumulator generally designated 72 at station 13 (FIGS. 1, 2, 9).

Accumulator

The accumulator 72 (FIG. 9) comprises a vertical, tubular member that is oblong in horizontal, cross-sectional contour (FIG. 11), approximately conforming in length and breadth to the outline of one of the filled primary bags 4. The upper end of the accumulator is open to freely receive primary bags discharged from the upper end of conveyor 55. One of the lateral walls 73 (FIG. 9) of the accumulator extends upwardly in spaced opposed relation to the upper end of conveyor 55 and is secured along its upper edge to a portion of the frame 68 that supports the elevator conveyor. The wall 75 of the accumulator opposite wall 73 terminated below the discharged end of the accumulator and the lower end portions of the end walls 76 (FIG. 11) are inclined inwardly to coact at their lower terminal edges with the terminal lower edges of walls 73, 75 to define the edges of a downwardly directed discharge opening 77 that, in turn, substantially conforms in outline to the outline of a horizontally disposed bag 4.

The lower open end of the accumulator 72 is closed by a horizontally disposed gate 78 supported along two opposite edges in parallel grooves in guides 79 (FIG. 9) carried by frame 68. Gate 78 is reciprocable in said guides 79 for movement from the full line closed position to the open position 80 indicated in broken lines (FIG. 10).

Plunger rod 81 of air cylinder 82 (FIGS. 9, 12) is connected with gate 78 for moving the gate from closed position to open position and vice versa upon actuation of a solenoid actuated valve 83 in the air lines leading to the ends of cylinder 82.

Master Bag Machine

Figure 12:
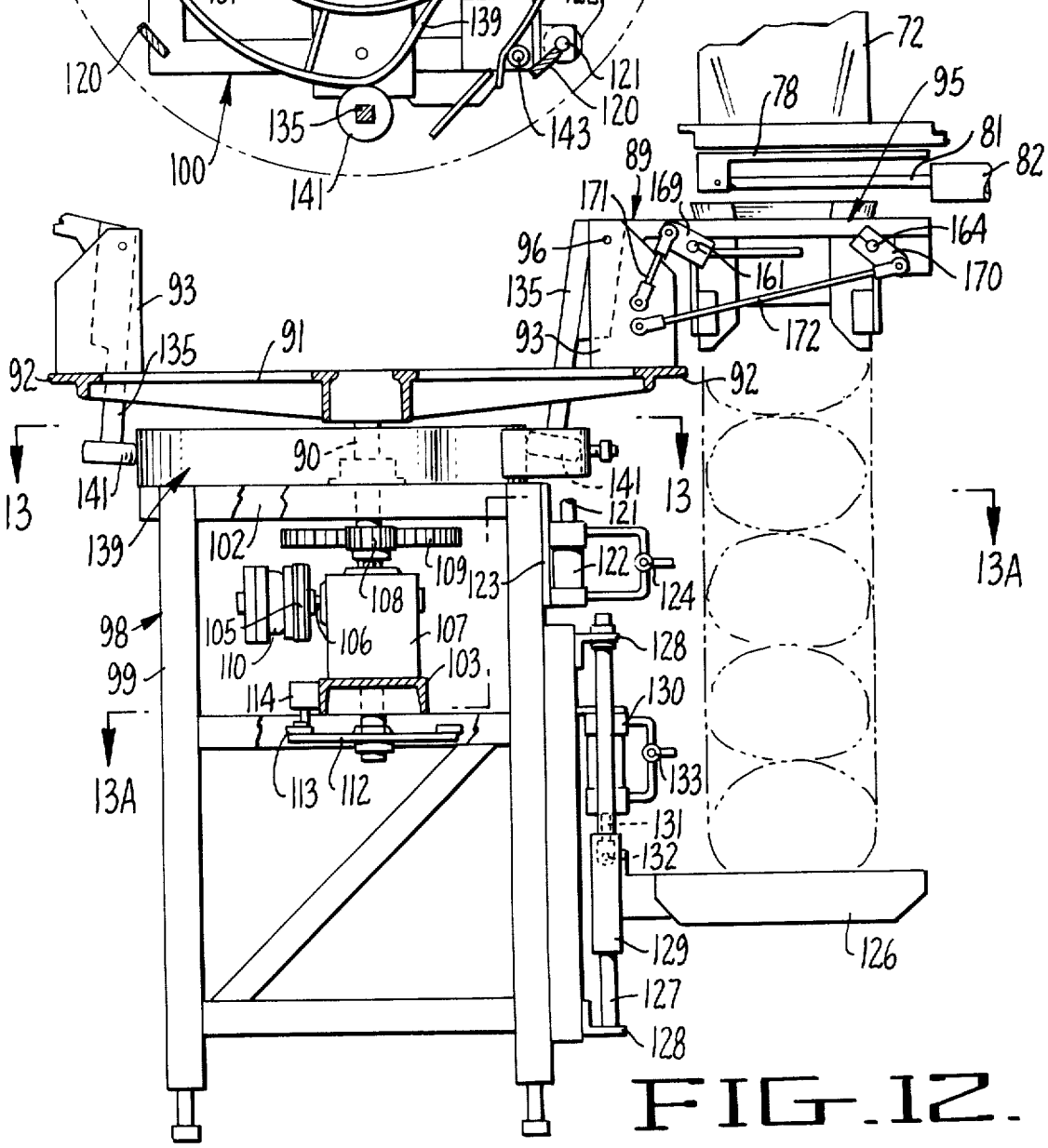
FIG. 12 is a fragmentary, part sectional, part elevational view of the master bag holder that is adjacent to and at a level below the upper end of the elevator with a filled master bag shown in broken lines.
Figure 13A:
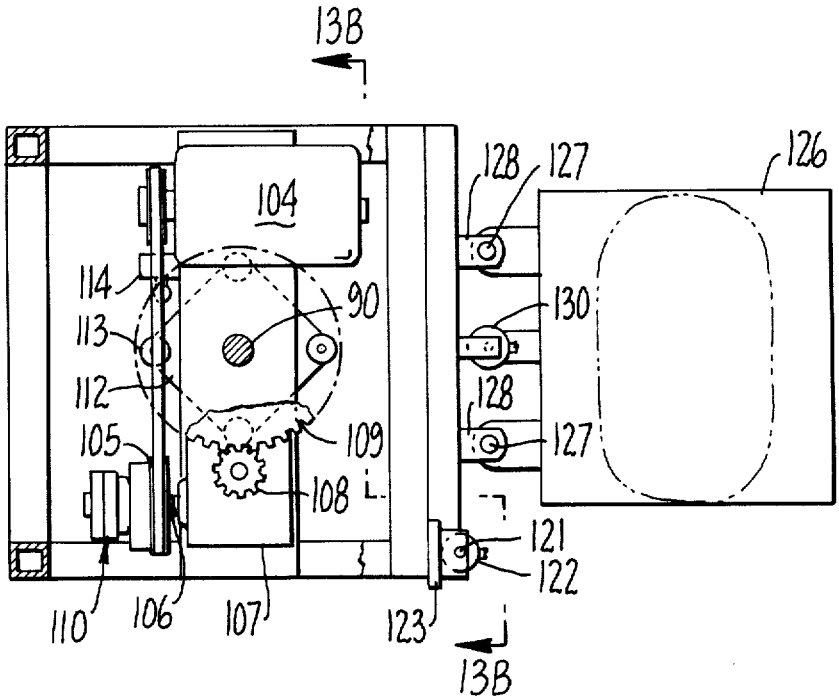
FIG. 13*a* is a sectional view at 13*a*—13*a* of FIG. 13.
Figure 13B:
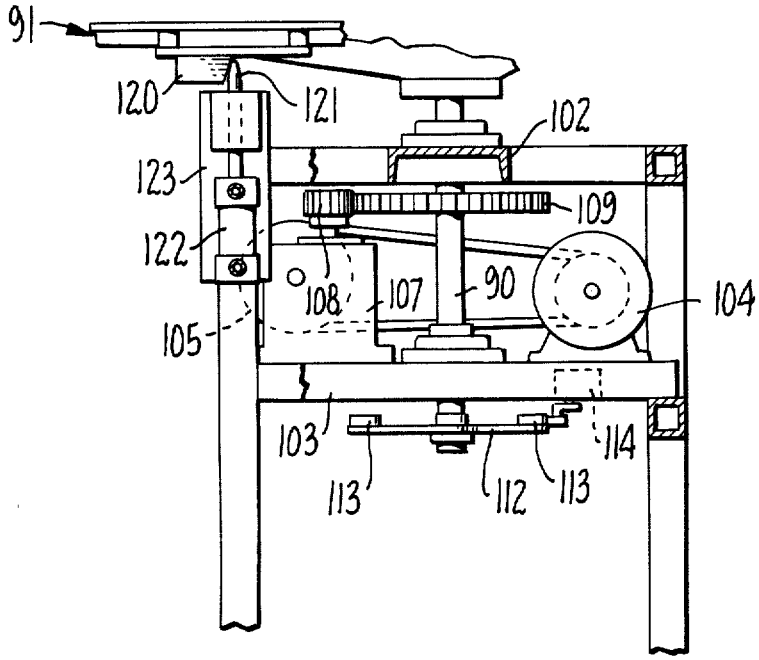
FIG. 13*b* is a fragmentary, elevational view along line 13*b*—13*b* of FIG. 13.

The master bag 10*b* shown in FIG. 2 is one of an annularly extending row, each releasably suspended at its upper end from a bag hanger, generally designated 89 (FIGS. 1, 12). Said hangers are in an annular row centrally supported on a vertical shaft 90 for rotation about the axis of said shaft upon rotation of the latter.

A horizontally disposed spider wheel 91 (FIG. 12) is centrally secured to the upper end of shaft 90, and the circular rim 92 of the wheel has a plurality of equally spaced pairs of upstanding brackets 93 secured thereon. The brackets of each pair are in spaced opposed relation, one such pair being shown in top plan view in FIG. 15, and each pair supports one side 94 of a rigid, rectangular frame 95 (FIGS. 1, 15) for tilting movement of said frame about the axis of a horizontal shaft 96. Four such frames are indicated in FIG. 1, and each is oblong in outline with the longest sides extending longitudinally of the row thereof.

Frames 95 are supported by each pair of brackets 93 and shaft 96 in a position projecting radially outwardly of the rim 92 of the wheel 91 (FIG. 14), and the sides 94 through which shafts 96 extend are tangential to a circle coaxial with the central shaft 90 (FIG. 1).

The frame of the master bag machine as a whole is generally designated 98 (FIG. 12), and is provided with legs 99 that, in turn, support a rigid, horizontal, rectangular frame 100 on their upper ends (FIGS. 12, 13), and a cross frame member 102 (FIG. 13) extends between and is secured at its ends to two of the opposed sides of said frame 100. The upper and lower end portions of shaft 90 are respectively supported in a bearing on the upper cross frame member 102 and in a lower similar cross frame member 103 (FIG. 12). A platform on cross frame member 103 supports a motor 104 the shaft of which carries a pulley connected by a V-belt with a pulley 105 (FIG. 12) on a shaft 106 that is operatively connected through a gear box 107 with a pinion 108. The teeth of pinion 108 are, in turn, in mesh with the teeth on a gear 109 that is secured on shaft 90 for driving the wheel 91, and a clutch assembly 110 on the shaft 106 provides for intermittently driving the pinion 108 and consequently the shaft 90 and wheel 91.

A rotary switch actuator 112 is centrally secured on shaft 90 adjacent its lower end and has a switch actuating roller 113 at each of four equally spaced points around said shaft. A switch 114 is positioned adjacent said switch actuator for actuation by said rollers in succession at each intermittent movement of shaft 90 and frame 100 through 90° (FIGS. **12, 13, 13*b***).

Secured to the underside of wheel 91 at four equally spaced points therearound is a stop member 120 (FIGS. **13, 13*a***) projecting downwardly from the wheel.

At one of the four legs 99 that respectively extend downwardly from the corners of the rectangular frame 100 is a vertically reciprocable dog 121 (FIGS. **13, 13*a*) that is connected with a plunger in air cylinder 122 secured on said leg 99 by a suitable bracket 123. A solenoid actuated valve 124 (FIG. 12) in air lines connected with the ends of cylinder 122 actuate the dog for upward extension into the path of the stop 120 upon each 90° movement of the wheel 91** to stop the wheel in a predetermined position, and after a predetermined interval of time the valve is actuated to quickly release the wheel for another movement through 90°.

Frame 98 is positioned adjacent the discharge end of the elevator conveyor 55. There are four equally spaced bag hangers 89. One of these supports bag 10c directly below the discharge opening 77 of the accumulator 72.

Figure 14:
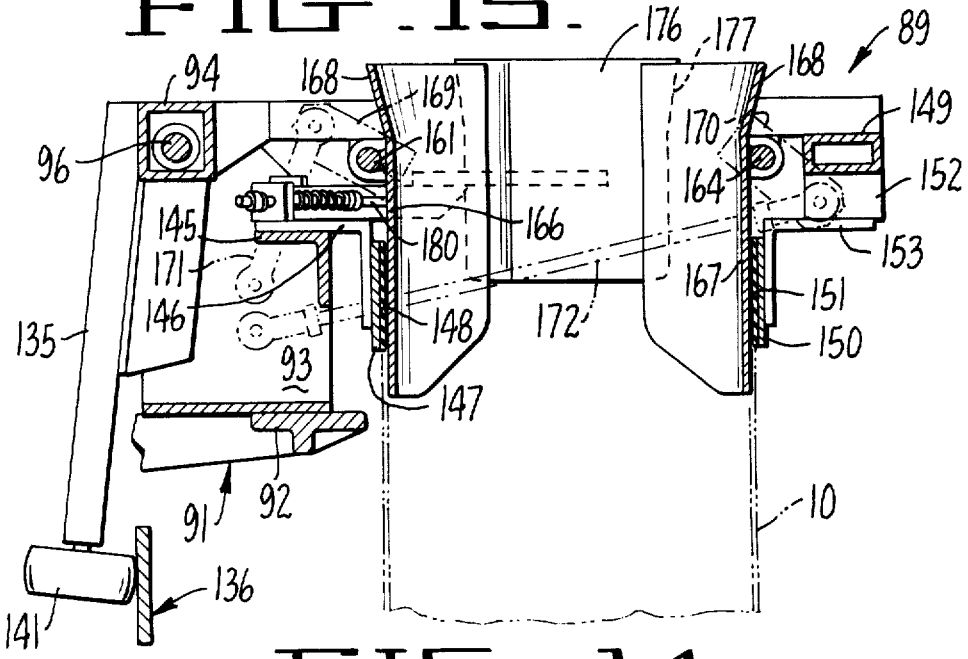
FIG. 14 is an enlarged, vertical cross-sectional view of the cam actuated master bag holder, the elements indicated in dot-dash lines being shown in elevation in FIG. 12. Dot-dash lines also indicate the master bag.

Also supported on frame 98 at one side thereof in a position directly below the accumulator 72, and below a master bag suspended from a hanger 89 at position 10c is a platform 126. This platform is horizontal and is supported along one edge on a pair of vertical cylindrical posts 127 that are secured by brackets 128 to one side of frame 98 (FIGS. 12, 14). Tubular guides 129 and platform 126 are vertically reciprocable on posts 127.

A vertical air cylinder 130 is centrally positioned between posts 127 and is also rigid on frame 98. A plunger rod 131 depends from said cylinder and is pivotally connected to said platform at 132.

Platform 126 is held in an elevated position to engage the lower end of a master bag in a receiving position at **10*c*** when the primary bags are discharged into a master bag to take the weight of the primary bags as they are received.

A solenoid valve 133 in the air lines connected with cyclinder 130, solenoid valve 124, and the clutch brake 109 are in the control circuit and are actuated to effect lowering of the platform 126, release of the hanger frame 100 for rotation, and rotation of the frame through 90°, for positioning an empty bag below the accumulator 72.

The side 94 of each hanger frame 95 is the inner side, or the side that is on the inside of the row of frames.

An arm 135 extends downwardly from each side 94 (FIG. 14), and is rigidly connected at its upper end to side 94. From this it is seen that each hanger frame 95 will be tilted about a shaft 96 upon swinging the lower end of each arm toward and away from the shaft 90 that supports the hanger frames (FIG. 12).

Figure 13:
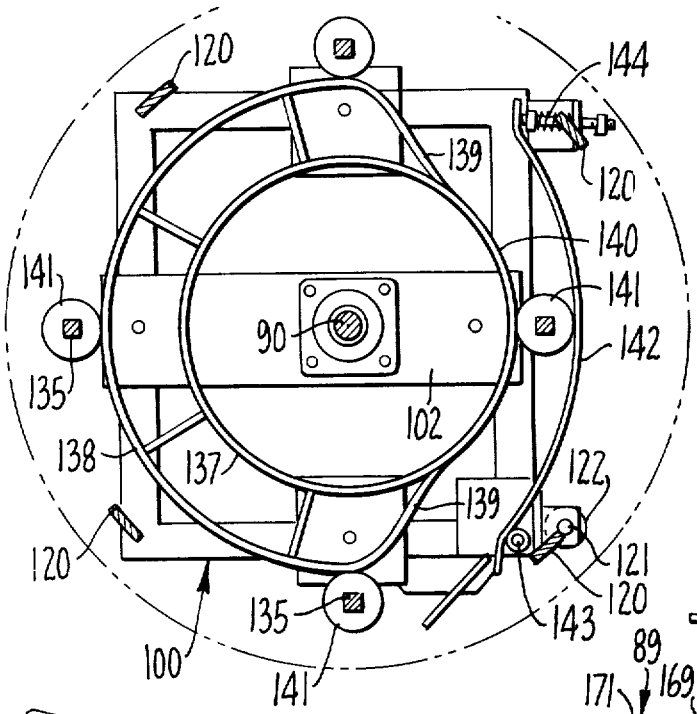
FIG. 13 is a cross-sectional view along line 13—13 of FIG. 12.

Rigidly supported on the upper rectangular frame 100 is a horizontally disposed cam generally designated 136 (FIG. 13). This cam as illustrated comprises a central cylindrical member 137 that is coaxial with shaft 90, and an outer member 138 that is also cylindrical and coaxial with shaft 90, except for its end portions 139 that converge to meet the outer surface of the inner member 137 to leave a radially outwardly exposed section 140 of the inner member at the side of each frame 98 opposite side 94.

Secured on the lower end of each arm 135 is a cam follower 141 that engages the exposed portion 140 of the inner cam member 137 and, which follower, upon rotation of the shaft 90 will move outwardly over one of the surfaces 139 to start tilting the frame 98 upwardly about shaft 96. Upon the follower reaching the cylindrical surface of the outer cam member 138 the frame will remain tilted to its maximum angle until it reaches the opposite end portion 139 when it will again move downwardly to horizontal, and it will remain horizontal during its travel over the outwardly exposed surface 140.

An outer arcuate guide strip 142 (FIG. 13) generally follows the exposed portion 140 of cam member 137 to guide the cam follower. Said strip 142 is pivotally supported on upper frame 100 at 143 at one of its ends. An expansion spring 144 reacts against the opposite end of the strip to yieldably urge the follower 141 against cam 140 at the filling station **10*c*. While the weight of frame 98 and the parts carried thereby will normally maintain the followers 141 in engagement with cam 136, the spring 144**, as will later appear, contributes to securely holding the master bag at its upper end during filling of the bag.

Extending between and secured at its ends to upstanding brackets 93, and spaced between the rim 92 of the spider wheel 91 and frame 95, is a horizontally extending angle strip 145 (FIG. 14). Said strip 145 has a horizontally disposed upper side. Secured to said angle strip centrally between its ends is an angle bracket 146 (FIG.

15) one leg of which extends over and is rigidly secured to angle strip 145 (FIG. 14), and the other leg of which is vertical and to which is secured a strip 147 having a resilient rubber-like bag engaging material 148 on one side.

Figure 15:
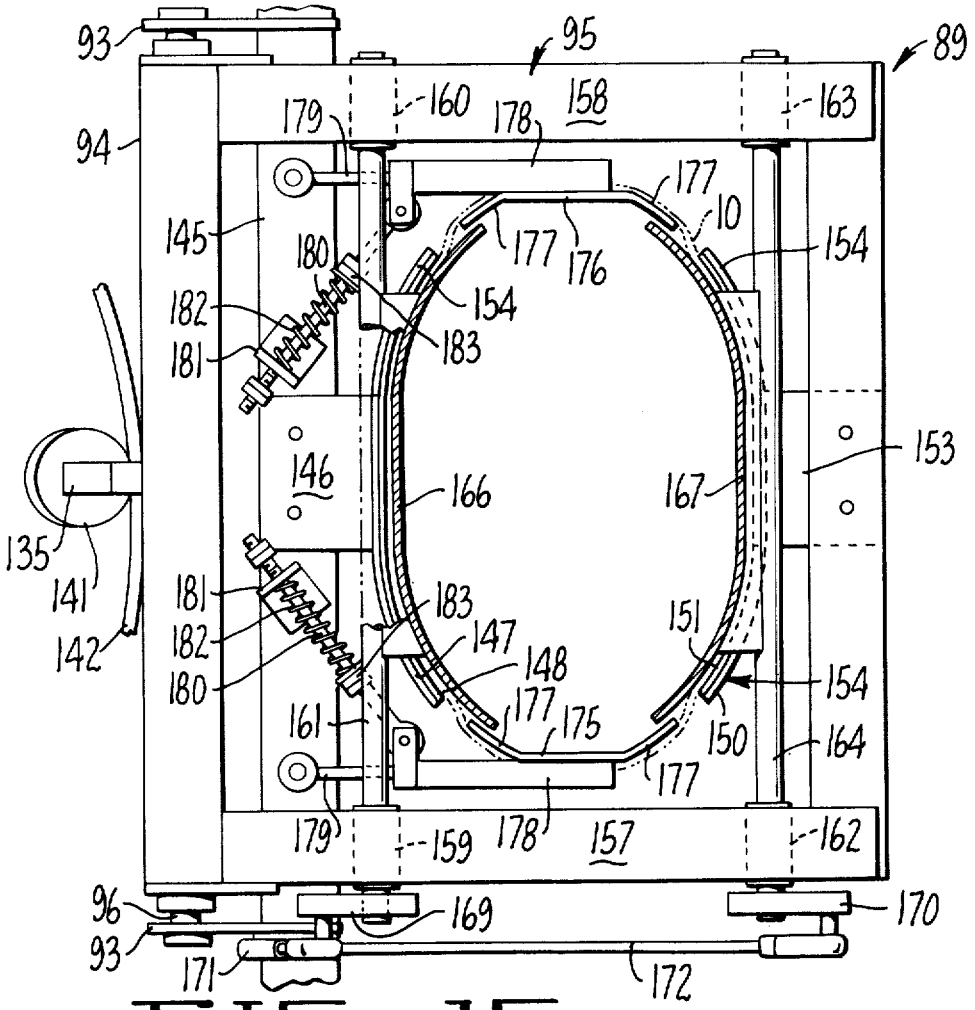
FIG. 15 is a top plan view of the structure shown in FIG. 14, the mouth of the master bag being indicated in dot-dash lines.

A corresponding strip 150 is rigidly secured to the side 149 of frame 95 that is opposite to the side 94 (FIGS. 14, 15). Strip 150 also has a resilient rubber-like facing 151 that faces the facing 148 on strip 147. A spacer 152 below side 149 and centrally between its ends is rigid on the latter and is secured to an angle bracket 153 that corresponds to angle bracket 146. Strip 150 is secured to angle bracket 153. These strips 147, 150 are elongated in the same direction as the oblong frame 95, and their opposite end portions 154 are curved toward each other (FIG. 15). The spacing between said strips is substantially the spacing between the longer sides of the upper end of a master sack when the sack is opened for filling. As will be later explained, the strips 147, 150 will function as outer clamp members against which the longer sides of the open mouth of a master bag are to be releasably clamped.

The opposite end frame members of each oblong hanger frame 95 are respectively designated 157, 158 (FIG. 15). Bearings 159, 160, respectively on end frame members 157, 158 rotatably support the opposite ends of a shaft 161 that extends longitudinally of each frame 95 and parallel with the side 94 of each frame, and which shaft is spaced above the strip 147.

Bearings 162, 163 also respectively on end frame members 157, 158, and equally spaced from bearings 159, 160 rotatably support the opposite ends of a shaft 164, that, in turn, is parallel with shaft 161.

Inner side clamps 166, 167 of a pair are positioned between the strips 147, 150, clamp 166 being adjacent strip 147 and clamp 167 being adjacent strip 159 when in bag clamping positions. Said side clamps 166, 167 are of the same structure and are of sheet material disposed vertically when in clamping position, and are each curved to conform to the linear curvature of the strip 147 or 167 adjacent thereto. Said side clamps extend beyond the ends of strips 147, 167, and also extend below and a substantial distance above said strips and above shafts 161, 164 with their upper end portions 168 (FIG. 14) flared outwardly relative to each other, to function as guides for guiding the primary sacks when each frame 95 is below the accumulator 72.

The central portions of shafts 161, 164 (FIG. 15) are rigidly secured to the outer sides of said clamps. Thus the inner side clamps 166, 167 are rotatable about the axes of shafts 161, 164.

A relatively short arm 169 is secured at one end to one end of shaft 161 outwardly of bearing 159, and a similar arm 170 is secured at one end to the end of shaft 164 that projects outwardly of bearing 162, bearings 159 and 162 being on the same end frame member 157.

Figure 16:
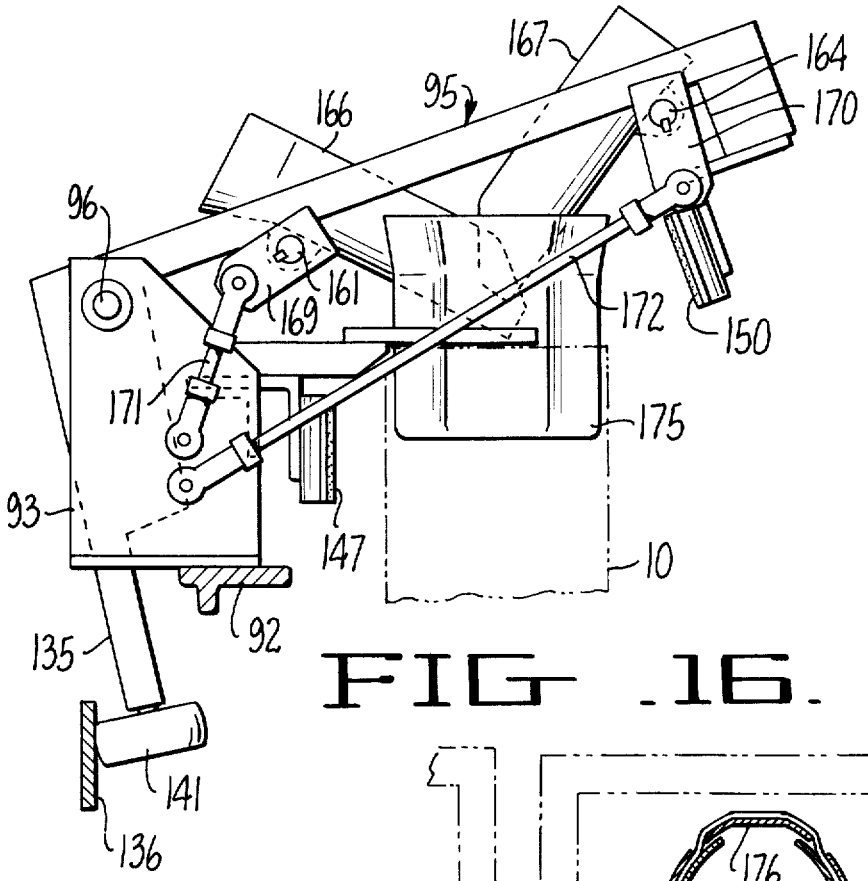
FIG. 16 is a part section, part elevational, enlarged view of the master bag holder seen in FIG. 12, the master bag being indicated in dot-dash lines, and the bag clamps and guides for guiding the smaller bags into the master bag being shown in an intermediate position for movement into or out of the master bag.
Figure 17:
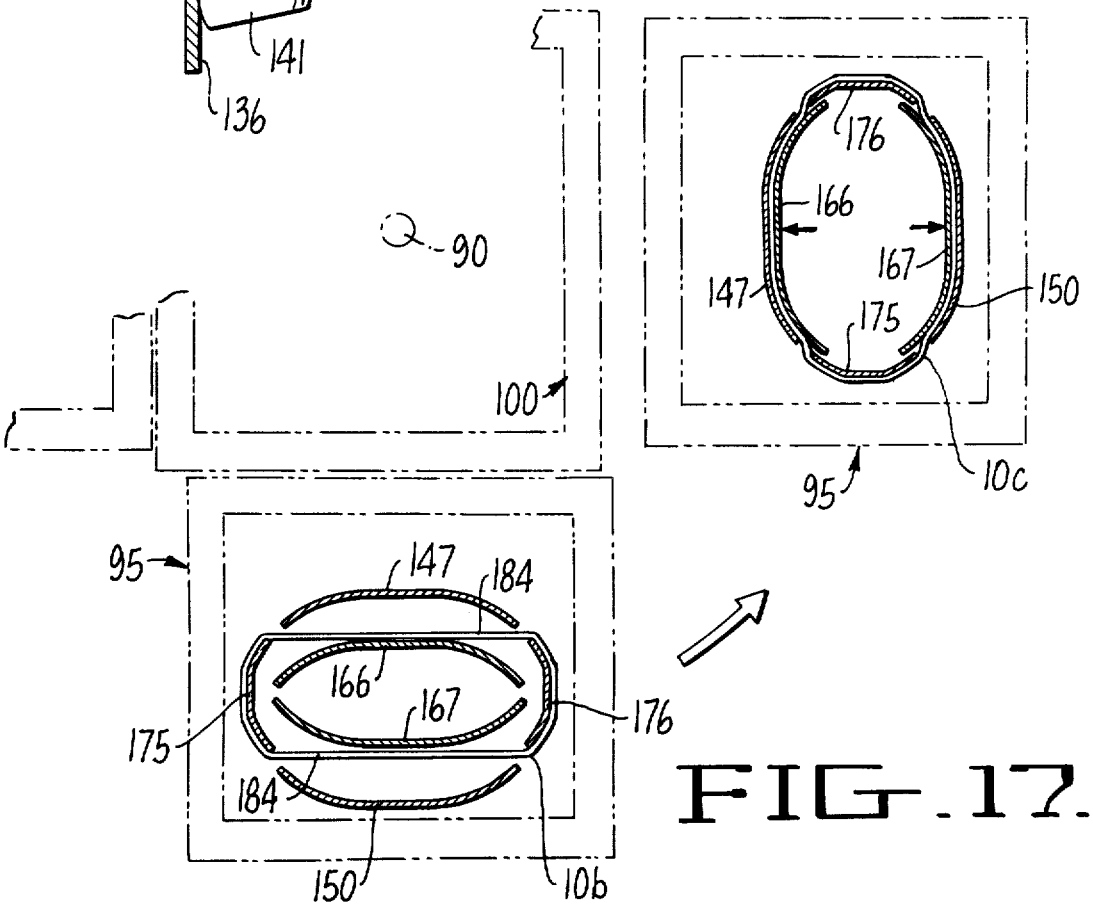
FIG. 17 is a horizontal cross-sectional view through two of four master bag holders on the turret indicated in FIG. 1 with portions of the turret shown in dot-dash lines, one bag holder being shown just after a master bag has been attached and the other in bag clamping position preparatory to filling.

One end of a link 171 is pivotally connected to the outer end of arm 169, and the opposite end of said link 171 is pivotally supported on the upstanding end bracket 93 that is adjacent, but positioned outwardly of the end frame member 157 of frame 95 (FIGS. 15, 16, 17). The dot-dash lines in FIG. 14 indicate the linkage that is indicated in full lines in FIGS. 15, 16.

The outer end of arm 170 that is secured to shaft 164 is pivotally connected to one end of a long link 172, and the opposite end of link 172 is also pivotally connected to the same end bracket 93 to which link 171 is pivoted.

The arrangement of the arms 169, 170 and links 171, 172 is such that upon the frame 95 being swung upwardly under the influence of movement of follower 141 on cam track 136, the lower ends of side clamps 166, 167 below shafts 161, 164 will swing inwardly and upwardly to a position above a master bag, (FIG. 16), the upper end of which was clamped between the cushions on strips 147, 150 and the outer sides of the lower end portions of side clamps 166, 167 before being elevated.

Upon downward movement of the frame 95, it is obvious that the lower end portions 166, 167 would swing downwardly and outwardly to clamp the sides of a bag 10 between said side clamps and the strips 167, 150.

End bag hangers 175, 176 are disposed vertically, and are in horizontally opposed relation to each other in positions outwardly of the opposite ends of the side clamps 166, 167 when the latter are in bag clamping positions (FIGS. 14, 17). Opposite end portions 177 of each of said opposedly positioned end hangers project toward each other past the end portions of the pair of clamping and guide members 166, 167 in lapping relation to the latter to the outer sides of said members when the latter are in vertically extending positions, and the upper portions of the pair of end bag hangers flare slightly outwardly relative each other.

The contour provided by the side clamp and guide members 166, 167 and the end bag hangers, when said clamp and guide members and end bag hangers are vertical and are viewed from above, is approximately the same as the contour of the discharge opening from the accumulator positioned above each bag hanger in the primary bag receiving station.

Each of the end bag hangers is secured on one end of a horizontally disposed arm 178 (FIG. 15). Said arms are parallel and an extension 179 is pivotally supported at its outer end on angle strip 145 that is adjacent to and parallel with the side frame 94 of each hanger 95 for swinging the arms and the end bag hangers horizontally toward and away from each other.

Each arm 178 is pivotally connected with one end of a spring urged rod 180, the opposite end of which slidably and relatively loosely projects through an upstanding bracket 181 rigid on angle strip 145. A coil spring 182 around each rod 180 reacts between each bracket 181 and a collar 183 secured on rod 180 for yieldably urging the bag hangers 176 outwardly relative to each other and for resisting inward movement toward each other.

In operation, at the bag applying station **10*a* (FIGS. 1, 2) the side bag clamps and guide 166, 167 will be in elevated positions above the upper level of a bag 10 when the latter is suspended from the master bag hanger (FIG. 16**).

An operator at the bag applying station or position will manually urge the end hangers 175, 176 toward each other and will slip the upper open end of a bag 10 over the lower portions of said end hangers to the level of arms 178, and at the same time the portions 184 (FIG. 17) of the mouth of such bag extending between said end bag hangers will extend across the space between said end hangers. In this position the bag 10 will be suspended from the end bag hangers 175, 176 with its upper end open.

Upon movement of the bag hanger 95 past the position **10*b*, the cam follower 141 will move inwardly along the end portion 139 of the cam track 136 and will be engaged by spring loaded cam 142 to provide additional clamping pressure on the bag while the latter is being filled, and the side clamp and guide members will swing into the mouth of the bag to firmly clamp the upper end of the bag between the lower portions of the side clamps 166, 167 and the friction facings of the strips 147, 150.**

The foregoing clamping operation occurs by the time the bag is in the receiving position 10*c* below the accumulator at the accumulation station 13.

After the predetermined plurality of primary bags are discharged into the master bag at 10*c*, the turret supporting the master bags is automatically actuated through the control system to carry the filled bag toward the position 10*d* (FIG. 2).

An upper horizontally disposed frame generally designated 185 (FIGS. 1, 1*a*) at approximately the upper level of the master bag turret extends around said turret, spaced outwardly of the latter, from opposite sides of the accumulator frame. This frame 185 may carry a photocell 186 actuated by failure in the interruption of the beam from a source inside the annular path of movement of the master bags suspended from the turret, due to lack of a bag to be filled, for stopping the motors and system as a whole until the switches are manually actuated to recommence the operation.

As the filled master bag suspended from a hanger 95 is moved to position 10*d* (FIG. 2) and off the platform 126, the cam follower 141 is beyond cam 142 and will engage the outwardly inclined portion 139 of cam track 136 to start swinging the side clamp and guide members out of clamping relation with the upper end portion of the master bag. At the same time the lower end of the filled master bag will be over the receiving end of a horizontally extending belt conveyor 190.

Take-Off Conveyor from Master Bag Turret

Figures 18, 21:
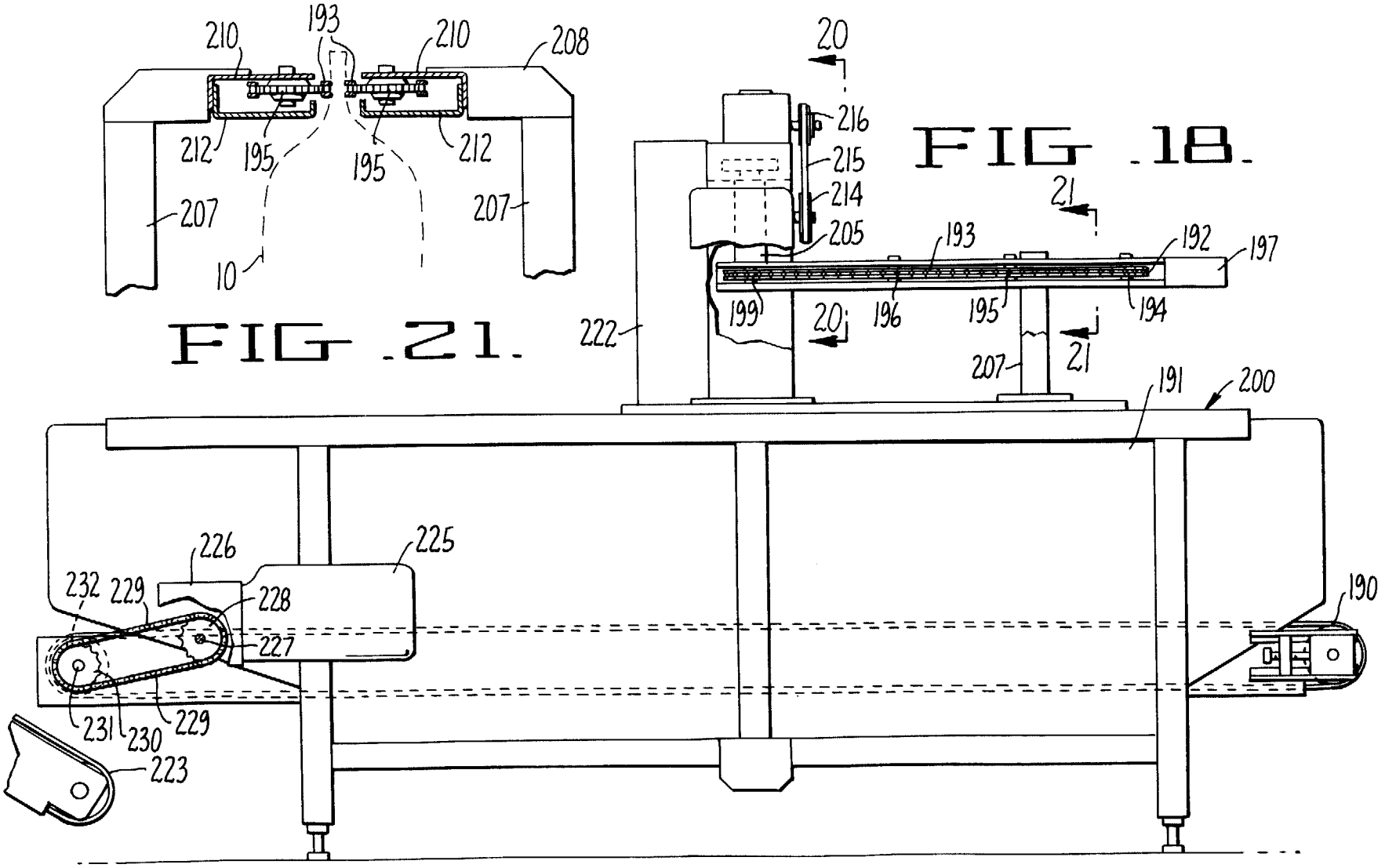
FIG. 18 is a side elevational view of the take-off conveyor, with the top closure means being shown thereon but as seen along line 18—18 of FIG. 19 and a conventional bag stitcher, sealer, stapler or the like indicated diagrammatically in full line.
FIG. 21 is an enlarged cross-sectional view along line 21—21 of FIG. 18.

The filled master bag approaching position 10*d* (FIG. 2) will be carried onto the receiving end of conveyor 190 between horizontally extending vertical side walls 191 (FIGS. 1, 21) and the opposite sides of the open upper end portion of the master bag will be progressively engaged between horizontally disposed convergently extending end portions 192 (FIG. 21) of a pair of endless chains 193. Said chains extend around a pair of sprocket wheels 184 at the divergent ends of said portions 192 and past sprocket wheels 195, 196 to progressively close the mouth of the master bag above the primary bags therein. Guides 197 adjacent and generally extending toward sprocket wheels 194 may assist in guiding the upper ends of the master bags to between the chains. Said chains 193 extend around sprocket wheels 198, 199 at the ends of the chain opposite sprocket wheels 194.

Figure 19:
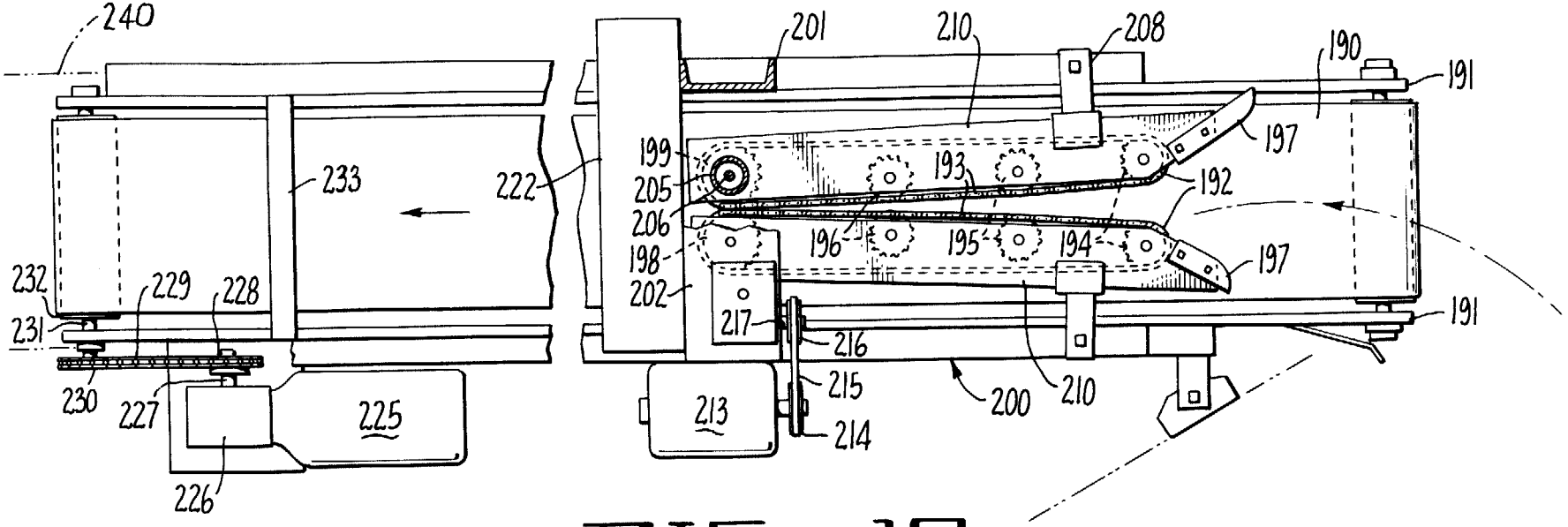
FIG. 19 is a top plan view of the portion shown in FIG. 18 with a portion of the master bag turret shown in broken lines.
Figure 20:
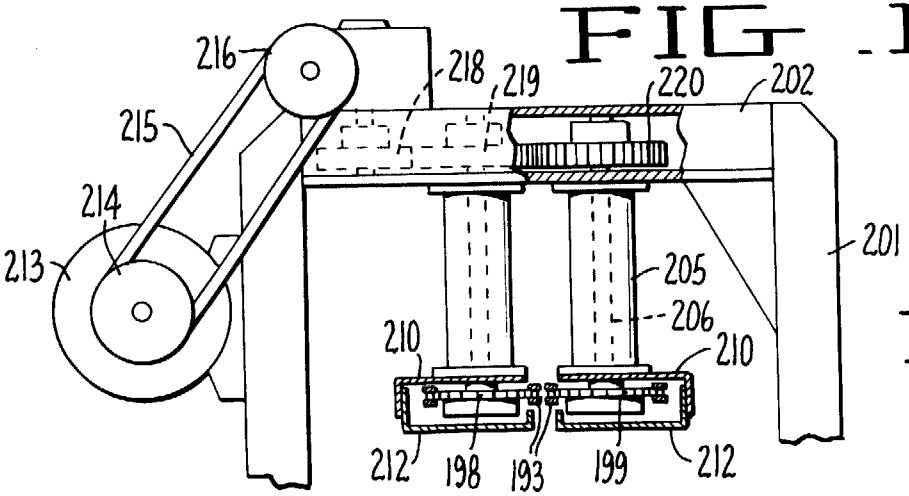
FIG. 20 is an enlarged fragmentary view as seen from line 20—20 of FIG. 18.

A frame generally designated 200 includes legs supporting the conveyor 190 (FIG. 1) and side guide walls 191, and upward extensions 201 on the frame adjacent the discharge end of the conveyor support cross member 202 (FIGS. 18–20) from which depend a pair of vertical tubular housings 205 (FIG. 20) through which shafts 206 extend. Said housings include bearings for said shafts and sprockets 198, 199 (FIG. 19) are respectively secured on the lower ends of said shafts.

Upward extensions 207 (FIGS. 18, 21) on frame 200 adjacent the receiving ends of the pair of chains 193 has arms 208 (FIG. 21) on their upper ends projecting toward each other, and the inner ends of said arms carry sprockets 194.

Horizontally elongated strips 210 in side-by-side relation are secured at one of their ends to the lower ends of the tubular housings 205 and to the inner ends of arms 208. The sides of these strips are horizontal and one strip extends over the sprockets 194, 195, 196 and 198 of one chain 193 while the other strip extends over the sprockets 194, 195, 196 and 199 of the other chain 193 (FIGS. 20, 21) leaving a gap between the adjacent edges of the strips for the upper ends of the upstanding filled master bags. Bearing on the strip 210 support the shafts carrying sprockets 194, 195, 196.

The strips 210 also carry the guides 197 (FIG. 19) and also extend convergently from the receiving to the discharge ends of the chains 193.

A lower, horizontally elongated, upwardly opening channel strip 212 (FIGS. 20, 21) below each strip 210 extends below the two rows of sprockets for chains 193 to coact with said strips 210 to provide a housing for each chain with the adjacent runs of the pair of chains projecting from the adjacent sides of the housing for engaging and gripping the upstanding ends of the filled master bags as the latter are delivered onto conveyor 190 from the turret supporting the bags at the filling station. This delivery occurs at the point of release of the bags, the upper end of each being progressively flattened between the adjacent runs of the chains adjacent the delivery point.

The upper end of each bag 10 is closed by the time it reaches the sprockets 190, 199 and said upper end passes a conventional stitcher (FIG. 18) where the sides of the closed mouth of the bag are stitched together.

Stitcher 222 is a conventional stitcher, being one of several kinds, each, however, being provided with a power driven stitching mechanism automatically actuated by engagement with the upper end of the bag.

In the apparatus shown, the conveyor 190 is driven by a motor 225 (FIG. 19) through gears in a gear box 226 having power take-off shaft 227. A sprocket wheel 228 on shaft 227 connects by chain 229 with a sprocket wheel 230 on the shaft 231 of the belt pulley 232 at the discharge end of the conveyor.

The endless chains 193 are driven by a motor 213 (FIG. 20) the rotor shaft of which carries a pulley 214 which connects by a V-belt 215 with a pulley 216 on the take-off shaft 217 of a gear assembly in box for driving a gear 218 the teeth of which are in mesh with a gear 219 on the upper end of one of the shafts 206 that supports sprocket 198. A gear 220 on the upper end of the shaft having sprocket 199 thereon has its teeth in mesh with the teeth of gear 219.

A cross bar 233 at the discharge end of the conveyor 190 extends across the conveyor at an elevation that will intercept the upper end of each filled, closed bag to cause it to fall on its side for discharge from the end of said conveyor onto any suitable support, which may be an additional conveyor 240 (FIG. 1)—and which conveyor 240 may be inclined upwardly to a height for convenient delivery to a standing workman or to some other unloading location.

CONTROL SYSTEM

The motors 19, 36, 64, 105 respectively driving the primary bag take-off 19, transfer conveyor 35, elevator conveyor 55 and the main shaft 90 of the master bag hanger turret 89, including the motors 225, 213, and the motor driving the Weigh-O-Matic machine are continuously actuated when the system is in operation, after an initial reset period to clear the machine.

The Weigh-O-Matic machine, primary bag take-off 16, and the transfer conveyor are also continuously actuated after an initial reset period to clear the machine. Thus the movement of the succession of primary bags to the transfer point where the primary bags are transferred to the elevator conveyor 55 for subsequent movement to the discharge point 9 at the upper end of conveyor 55, is continuous.

A solid state logic L (FIG. 3) comprises standard electrical components grouped together to perform conventional logic functions which logic is attached to and works with a conventional two level electronic counter C. The modules or electrical components utilized in the logic L are commercially available from different sources, one being Allen Bradley Catalogue, 1971, as is the electronic counter, such as Durant Counter 2000.

Figure 3:
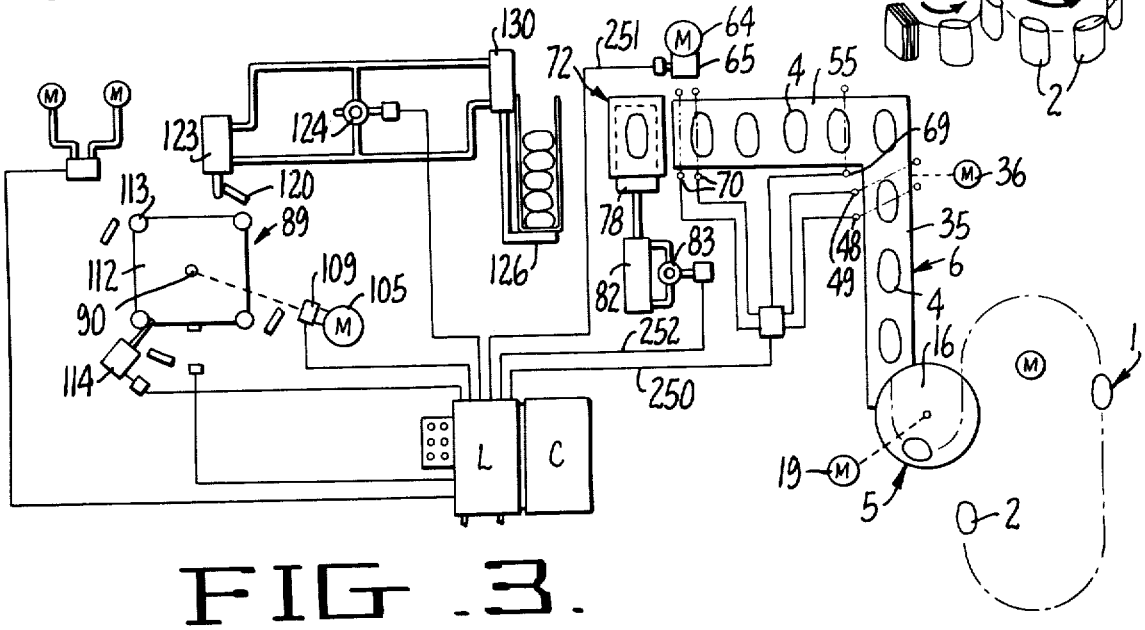
FIG. 3 is a semi-schematic simplified view of the electrical control system in which a logic and two-level counter are incorporated.

In FIG. 3, the separate electrical conductors from photocells 48, 49, 69, 70 are indicated as extending through a conduit 250 to logic L to avoid a confusion of lines. A conduit 251 extends from the clutch brake 65 of the elevator conveyor to logic L while conduit 252 connects the solenoid valve 83 for actuation of the accumulation gate 78 with the logic L. Each conduit includes the conductors for actuating the clutch brake 65 and solenoid valve 83.

In operation, the interruption of both beams to photocells 48, 49 at one time notifies the logic that an indexing of the elevator conveyor is to take place after a primary bag has been discharged into the lowermost pocket 63 of the elevator conveyor. Photocell 69 indicates to the logic that the belt has advanced one flight forward and provides accurate alignment of the succeeding flights.

In the event one or neither of the beams to photocells 48, 49 are interrupted at one time, it indicates either a broken bag 4 or no bag, has been discharged into pocket 63 and the conveyor 55 will not be actuated until a full, properly closed bag 4 has been discharged from the transfer conveyor 35 into a pocket 63.

The logic L circuitry evaluates the information received from photocells 48, 49 and 69 and initiates actuation of the clutch brake 65 for intermittently advancing the elevator conveyor, one pocket at a time in synchronism with the conveyor 35.

Assuming, as an example, five ten pound bags of potatoes are to be discharged into each of the four master bags adapted to be suspended from hangers carried by shaft 90 to the receiving station 11 below the accumulation station 13 (FIG. 2). In the present system, if an uninterrupted succession of five adjacent pockets 63 on the elevator conveyor 55 has a properly filled bag 4 therein, a predetermined number of said bags, less than five, will be discharged into accumulator 72 during the time interval required to remove the previously filled bag at position 10*c* and to advance a master bag at 10*b* (FIG. 2) to position 10*c*. At this point the gate 78 of the accumulator is opened by actuation of air cylinder 82 and solenoid valve 83, and the accumulated bags will drop into the master bag. The gate will remain open until the remainder needed to make up the five bags have been directly dropped into the master bag, when the gate will close.

The circuitry of the two level counter C (FIG. 3) is connected with the circuitry of logic L, and the counter takes the count signals from the photocells 70 at the upper end of the elevator conveyor 55, which, in the example would be three (for the three in the accumulator) and two (for the additional two bags) and effects actuation of the solenoid valve 83 for gate 78 and the actuation of the clutch 109 of the master bag turret through the logic L. The counter C is reset automatically after the final valve and clutch actuation.

In the event the beams to neither one of the photocells 70 is obstructed, no count will be received by the counter, and the solenoid valve 83 and clutch 109 will not be actuated until the required predetermined number of properly filled and closed primary bags are discharged into a master bag.

From this it is seen that the length of the time interval between the replacements of said master bag at the primary bag receiving position 11 will substantially correspond to the sum of the time intervals between the discharges of the adjacent pairs of primary bags of the portion of the succession of the predetermined plurality in said row, including the primary bag at said discharge point, irrespective of variations in the spacing between said adjacent pairs of primary bags. Thus, if a primary bag has been removed from the row on the elevator conveyor 55, or the surface 8 (FIG. 1, 2) the master bag at position 11 will not be replaced until the correct predetermined number of bags 4 have been discharged from the conveyor 55.

The fact that there may have been an excess of articles discharged into one of the pockets 63 between an adjacent pair of flights 56 on conveyor 55, and may be discharged into a master bag at the receiving station 10 is immaterial. A flattened or short bag failing to obstruct the beams 50, 51 (FIG. 7) at one time, will not prevent discharge of the articles, or the flattened or short bag onto the elevator conveyor 55, nor will there be any omission in the indexing of the elevator conveyor to advance the products on the latter.

While the system hereinabove described shows a take-off device at station 5 that delivers the filled primary bags, from a single bagging machine 14, the delivery of filled bags onto the conveyor 35 may come from various sources or places, and the transfer onto the conveyor 35 may be manual.

I claim:

1. The method of packaging a uniform plurality of filled primary containers in master containers that includes the steps of:

a. moving a succession of said primary containers in arranged in a row, in one direction along a path extending longitudinally of said row to discharge point, and discharging said primary containers from said path at said point, b. positioning an upwardly opening empty master container in a receiving position for receiving primary containers discharged from said point;

c. accumulating at an accumulating station between said discharge point and a master container in said receiving position, a predetermined number of primary containers less than said uniform plurality, as they are discharged from said point, then;

d. discharging the primary containers so accumulated at said accumulating station into the master container in said receiving position and a approximately the same time discharging directly from said discharge point past said accumulating station into said master container additional primary containers in a number to fill said master container with additional primary containers in sufficient number to make up said uniform plurality thereof.

2. In the method as defined in claim 1:

e. removing the filled master container from said receiving position immediately after it is filled with said uniform plurality of primary containers and replacing it with an empty upwardly opening master container, and during the time of said removal and replacement, again accumulating primary containers at said accumulating station for discharge into the master container in said receiving position together with additional primary containers in said number, and thereafter;

f. repeating said cycle of accumulation, discharge, removal and replacement at uniform time intervals.

3. In the method as defined in claim 1:

e. the movement of said primary containers from said discharge point into a master container in said receiving position being under the influence of gravity.

4. In the method as defined in claim 1:

e. the accumulation of said primary containers at said accumulating station being in a vertical row, one on top of the other, and the path of movement of said additional containers being unobstructed through the space occupied by the acumulated containers before discharge of the latter into the master container at said receiving station.

5. In the method as defined in claim 1:

e. the discharge of said primary bags at said discharge station being intermittent at uniform intervals of time.

6. In the method as defined in claim 2:

f. supporting a succession of equally spaced empty master containers for intermittent movement, one after the other, to said receiving position to effect said replacement of a filled master container upon removal of a filled master container from said receiving position, and so moving the master containers of said succession thereof in predetermined timed relation to the discharge of said primary containers from said discharge point and to the discharge of said accumulated primary bags from said accumulating station.

7. The method of forming bales of a uniform plurality of elongated, filled primary bags that includes the steps of:

a. supporting a succession of said filled primary containers arranged on their sides in a row with their longitudinal axes in spaced side-by-side relation in one direction along a path extending longitudinally of said row to a discharge point; and discharging said primary bags from said path at said point;

b. suspending from its upper end an upwardly opening, elongated, empty master bag vertically in a receiving position for receiving filled primary bags from said discharge point;

c. accumulating at an accumulating station between said discharge point and an empty master bag in said receiving position, a predetermined number of filled primary bags less than said uniform plurality, as they are discharged from said point; then d. discharging the primary bags so accumulated at said accumulating station into said master bag in said receiving position and at approximately the same time, discharging directly from said discharge point past said accumulating station into said master bag additional primary bags in a number to fill said master bag with additional primary bags of sufficient number to make up said uniform plurality thereof.

8. In the method as defined in claim 7:

e. removing the filled master bag from said receiving position immediately after it is filled with said uniform plurality of primary bags and replacing it with an empty master bag suspended from its upper end in said receiving position, and during the time of said removal and replacement, again accumulating filled primary bags at said accumulating station for discharge into the master bag suspended in said receiving position together with additional primary bags in said number, and thereafter repeating said cycle of accumulation, discharge, removal and replacement at uniform time intervals.

9. In the method as defined in claim 7:

e. the movement of said primary bags from said discharge point into said master bag at said receiving position being under the influence of gravity;

f. supporting said master bag at said receiving station from below in addition to suspension from its upper end when said master bag is in said receiving position and during discharge of primary bags into said master bag;

g. removing said master bag from its support from below after it has received said predetermined plurality of primary bags and at approximately the same time moving said filled master bag from said receiving position onto a supporting surface extending and moving away from said receiving position for movement of said master bag with said surface and in a path extending away from said receiving position;

h. releasing said master bag from suspension upon movement thereof onto said moving surface for transferring the weight of said filled master bag onto said last mentioned surface, and at approximately the same time;

i. engaging the released upper portion of said master bag and progressively closing it and securing the closed upper end in closed condition.

10. In the method as defined in claim 8:

f. the length of the time interval between the removal and replacement of each master bag at said receiving position approximately corresponding to the sum of the time intervals between the completion of discharge of said predetermined number of properly filled primary bags from the succession in said row irrespective of variations in the spacing between the primary bags of said row.

11. The method of forming bales of discrete articles comprising the steps of:

a. suspending a plurality of primary bags of predetermined uniform size having lateral sides and upwardly opening upper ends from said upper ends, with said bags arranged in a horizontally disposed first row;

b. moving said primary bags in one direction in a path extending longitudinally of said first row;

c. depositing a plurality of said articles into each primary bag to an approximately uniform total weight at a first point along said path and during said movement of said bags, and then;

d. closing the upper open end of each primary bag at a second point along said path and at substantially the same time securing said upper end closed, and thereafter e. releasing each bag from suspension from its upper end and continuing its movement along said path, supported from below, to a discharge point for discharge one at a time from said path;

f. suspending a succession of master bags of uniform size and upwardly opening upper ends from their upper ends, arranged in a horizontally disposed second row for movement successively to receiving position below said discharge point, and receiving therein a predetermined uniform plurality of the primary bags discharged from said discharge point;

g. moving each master bag away from said receiving position after it has received said plurality of primary bags therein, and closing the upper end of each master bag during said last mentioned movement and securing it closed.

h. said movement of said master bags to and from said receiving position being intermittent with each master bag being stationary while in said receiving position;

i. accumulating a group of primary bags in number less than said predetermined uniform plurality at an accumulating station between said discharge point and the master bag at said receiving position during the period of movement of a filled master bag away from said receiving position and the replacement of an empty master bag in said receiving position, then;

j. discharging the primary bags so accumulated at said accumulating station followed by additional primary bags discharged directly from said discharge points in a number to make up the deficiency between the number of accumulated bags and the total predetermined uniform plurality of bags for the master bag in said receiving position.

12. In apparatus for baling a predetermined plurality of uniformly filled primary packages in larger master containers comprising:

a. a conveyor for supporting and moving a succession of said filled primary packages for movement to a discharge point for successive discharge at said point and downward movement from the latter under the influence of gravity along a predetermined path into a master container at a package receiving station spaced below said point, and conveyor actuating means connected with said conveyor actuatable for effecting said movement;

b. a container support spaced below said discharge point at said receiving station for supporting a master container for receiving packages discharged from said discharge point;

c. an accumulator between said discharge point and said receiving station including an obstruction at a location along said path supported for movement from a closed position extending across said path obstructing downward movement of primary packages along said path, to an open nonobstructing position for free downward passage of packages past said location, and vice versa;

d. obstruction actuating means connected with said obstruction intermittently actuatable for moving said obstruction from said closed position to said open position upon a predetermined number of said uniformly filled primary packages less than said predetermined plurality, being accumulated on said obstruction, and for holding said obstruction in said open position until additional primary packages in a number to complete said predetermined plurality have been discharged from said point and passed said obstruction; and e. control means actuatable in response to movement of uniformly filled primary packages at said discharge point operatively connected with said obstruction actuating means for effecting said movement of said obstruction from said closed position to said open position and for effecting movement of said obstruction to said closed position immediately after said predetermined plurality of said packages have passed said location.

13. In apparatus as defined in claim 12:

f. said container support comprising one of a succession adapted to support a master container for movement from an attaching station to said receiving station and to support each master container for movement from said receiving station to a discharge station after the master container at said receiving station has received said predetermined plurality of packages, and then back to said attaching station, and for support actuating means connected with the succession of container supports for effecting said movement of said supports;

g. said control means being also connected with said support actuating means for moving said obstruction from said open position to said closed position and for holding the latter in said closed position only during actuation of said support actuating means for moving a filled master container from said receiving station to said discharge station and for moving the next support of said succession and the empty master container supported thereby to said receiving station.

14. In combination with the apparatus as defined in claim 13:

h. closing means adjacent said receiving station including a container carrier for receiving a filled master container upon movement to said discharge station for carrying each filled master container away from said receiving station, and means connected with said carrier for moving the latter to so carry each container away from said receiving station;

i. said closing means including gripping means for gripping engagement with containers on said carrier for closing said carriers during said movement of the latter for carrying said filled containers away from said receiving station, and means connected with said gripping elements for moving them in the same direction as said carrier after they are in gripping relation with said containers.

15. The combination as defined in claim 14 in which:

j. said container supports include clamping elements movable into clamping relation with each master container at said attaching station and during movement of said supports to said discharge station, and movable to container releasing station only after each container has been gripped by said gripping means; and k. means for holding said clamping elements out of clamping position during movement from said discharge station to said attaching station.

16. Baler apparatus for supporting bags for movement from a bag attaching station to a receiving station and from said receiving station to a releasing station, comprising:

a. bag supporting means for suspending an empty bag having an open end at said attaching station with its open end uppermost for movement, in succession, to said receiving station and to said releasing station, and moving means connected with said supporting means for so moving said bag;

b. said bag supporting means including bag clamping elements supported for movement downwardly into the open upper end of said bag and from collapsed condition to expanded spaced relation therein against two opposite inner sides of said bag at said open end during said movement of said bag to said receiving station, and for movement toward each other and upwardly out of said open end to said collapsed condition during movement of said bag to said releasing station;

c. said clamping elements having portions integral therewith extending oppositely outwardly and upwardly relative to the bag into which said elements are adapted to extend when moved to said expanded condition at said receiving station for guiding objects into said bag;

d. element actuating means connected with said elements actuatable during movement of said bag supporting means to said receiving station and to said releasing station for moving said elements to said spaced, expanded relation and thereafter to said collapsed condition at said releasing station, in succession;

e. conveyor means for supporting objects thereon for movement to a discharge point for discharge of said articles at said point, and conveyor actuating means connected with said conveyor means for effecting said movement;

f. means supporting said bag supporting means when at said receiving station below said discharge point for receiving objects discharged from said conveyor means;

g. a support at said receiving station in a predetermined elevated position for supporting the lower end of a bag in said receiving position for supporting the weight of objects discharged into said bag at said receiving station;

h. means supporting said support for downward movement from said elevated position and relative to a bag thereon at said receiving station upon actuation of bag supporting means for moving the bag with the articles therein from said receiving station to said releasing station.

17. Baler apparatus for supporting bags for movement from a bag attaching station to a receiving station and from said receiving station to a releasing station, comprising:

a. bag supporting means for suspending an empty bag having an open end at said attaching station with its open end uppermost for movement, in succession, to said receiving station and to said releasing station, and moving means connected with said supporting means for so moving said bag;

b. said bag supporting means including bag clamping elements supported for movement downwardly into the open upper end of said bag and from collapsed condition to expanded spaced relation therein against two opposite inner sides of said bag at said open end during said movement of said bag to said receiving station, and for movement toward each other and upwardly out of said open end to said collapsed condition during movement of said bag to said releasing station;

c. said clamping elements having portions integral therewith extending oppositely outwardly and upwardly relative to the bag into which said elements are adapted to extend when moved to said expanded condition at said receiving station for guiding objects into said bag;

d. element actuating means connected with said elements actuatable during movement of said bag supporting means to said receiving station and to said releasing station for moving said elements to said spaced, expanded relation and thereafter to said collapsed condition at said releasing station, in succession;

e. a turret supporting a plurality of said bag supporting means for movement in a horizontally disposed annular path successively to and past said attaching station, receiving station and said releasing station;

f. each of said bag supporting means including a pair of spaced opposed bag spreaders supported for movement from retracted positions within the open end of one of said bags to extended positions in yieldable engagement with the two inner sides of said bag other than said two opposite sides for releasably suspending an empty bag therefrom during movement of said attaching station toward said receiving station and means for yieldably urging said bag spreaders to said extended positions;

g. said clamping elements being positioned between said bag spreaders when in said expanded spaced relation in clamping engagement with said two opposite inner sides, and means stationary relative to said clamping elements outside said two opposite sides of a bag when said clamping elements are in said expanded spaced relation and said bag in releasably suspended from said bag spreaders.

18. In apparatus as defined in claim 17:

h. means operatively connected with said clamping means for applying an additional amount of gripping pressure by each clamping element against the two opposite sides of said bag at said receiving station, as distinguished from the gripping pressure applied during movement to said receiving station, to resist slippage of the bag during filling at said receiving station.

19. In apparatus as defined in claim 17, in which the bags adapted to be suspended from said supporting means are relatively large master bags and the objects to be discharged therein are relatively small, uniformly filled primary bags:

h. said conveyor means comprising a generally horizontally elongated conveyor having equally spaced upwardly projecting flights for supporting a primary bag between adjacent pairs of said flights for movement of said bags longitudinally of said conveyor, with said discharge point being at one end of said conveyor;

i. control means connected with said conveyor means, and with said moving means for moving said bag supporting means from said attaching station to said receiving station and from said receiving station to said releasing station, for holding said bag supporting means including the master bag suspended therefrom at said receiving station until a predetemined member of said filled primary bags have been discharged from said conveyor means into said master bag so held, and for thereafter moving the master bag to said releasing station.

* * * * *